US008622382B2

(12) United States Patent
Jang

(10) Patent No.: US 8,622,382 B2
(45) Date of Patent: Jan. 7, 2014

(54) PRINTING MEDIUM FEEDING CASSETTE AND IMAGE FORMING APPARATUS INCLUDING THE SAME

(75) Inventor: Jae-hwi Jang, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 551 days.

(21) Appl. No.: 12/903,355

(22) Filed: Oct. 13, 2010

(65) Prior Publication Data

US 2011/0129273 A1 Jun. 2, 2011

(30) Foreign Application Priority Data

Nov. 27, 2009 (KR) ..... 10-2009-0115700

(51) Int. Cl.
*B65H 1/04* (2006.01)

(52) U.S. Cl.
USPC ..... 271/171; 271/145

(58) Field of Classification Search
USPC ..... 271/145, 171
See application file for complete search history.

(56) References Cited

U.S. PATENT DOCUMENTS

| | | | | |
|---|---|---|---|---|
| 5,537,195 | A * | 7/1996 | Sagara et al. | 399/381 |
| 7,407,159 | B2 * | 8/2008 | Tazika | 271/171 |
| 7,668,502 | B2 * | 2/2010 | Park | 399/393 |
| 7,758,040 | B2 * | 7/2010 | Hashimoto et al. | 271/145 |
| 8,170,462 | B2 * | 5/2012 | Park | 399/393 |
| 2010/0124449 | A1 * | 5/2010 | Asada et al. | 399/393 |

* cited by examiner

*Primary Examiner* — Kaitlin Joerger
(74) *Attorney, Agent, or Firm* — Stanzione & Kim, LLP

(57) ABSTRACT

A printing medium feeding cassette usable with an image forming apparatus includes a first casing including a guide member which extends along a sliding direction, and a plurality of coupling parts arranged in a central area of the guide member to be spaced from each other along the sliding direction, a second casing which forms a printing medium containing space in cooperation with the first casing to slide along the guide member, a stopper to reciprocate in a direction transverse to the sliding direction between a coupling position in which the stopper is coupled with any one of the plurality of coupling parts and a releasing position in which the stopper is released from the coupling part, and a releasing member which is coupled with the second casing to move in the sliding direction in connection with the second casing and is moved by an external force applied thereto in the sliding direction to allow the stopper to move to the releasing position from the coupling position.

27 Claims, 26 Drawing Sheets

PRINTING MEDIUM FEEDING CASSETTE AND IMAGE FORMING APPARATUS INCLUDING THE SAME

CROSS-REFERENCE TO RELATED APPLICATIONS

This application claims priority under 35 U.S.C. §119(a) from Korean Patent Application No. 10-2009-0115700, filed on Nov. 27, 2009 in the Korean Intellectual Property Office, the disclosure of which is incorporated herein in its entirety by reference.

BACKGROUND

1. Field of the Invention

Embodiments of the present general inventive concept relate to a printing medium feeding cassette in which the size of a printing medium to be loaded therein can be conveniently adjusted by a user, and an image forming apparatus including the same.

2. Description of the Related Art

An image forming apparatus which forms an image on a printing medium is typically classified into an inkjet type, a thermal transfer type, or an electro-photographic type.

The image forming apparatus is provided with an image forming unit to form an image on a printing medium, and a printing medium feeding cassette to feed the printing medium to the image forming unit.

The printing medium feeding cassette includes a size adjusting unit to adjust a length or width thereof to be suitable for a size of the printing medium loaded therein, to thereby align the printing medium in place.

The size adjusting unit includes a plurality of coupling recesses which is formed in a main body of the printing medium feeding cassette to correspond to a plurality of printing medium sizes, and a stopper which is provided in a movable casing which slides with respect to the cassette main body and is coupled with any one of the plurality of coupling recesses. As the stopper is coupled with any one of the plurality of coupling recesses, the size of the printing medium feeding cassette can be adjusted.

However, in order for a user to adjust the size of the printing medium feeding cassette by using the size adjusting unit, the user must first separate the stopper from the coupling recess and then make the movable casing slide with respect to the cassette main body, which is inconvenient to the user.

Further, in order to separate the stopper from the coupling recess, the user should pull or push a lever connected with the stopper, which also causes inconvenience to the user.

Furthermore, it is difficult for the user to manipulate the size adjusting unit with one hand.

SUMMARY

Exemplary embodiments of the present general concept may provide a printing medium feeding cassette in which the size thereof can be conveniently adjusted by a user, and an image forming apparatus including the same.

Exemplary embodiments of the present general inventive concept may also provide a printing medium feeding cassette in which the size thereof can be conveniently adjusted by a single pushing or pulling action applied in a direction corresponding to a desired size.

Additional features and/or utilities of the present general inventive concept will be set forth in part in the description which follows and, in part, will be obvious from the description, or may be learned by practice of the general inventive concept The foregoing and/or other aspects and utilities may be achieved by providing a printing medium feeding cassette usable with an image forming apparatus, the printing medium feeding cassette including a first casing which comprises a guide member which extends along a sliding direction, and a plurality of coupling parts arranged in a central area of the guide member to be spaced from each other along the sliding direction, a second casing to form a printing medium containing space in cooperation with the first casing configured to slide along the guide member, a stopper to reciprocate in a direction transverse to the sliding direction between a coupling position in which the stopper is coupled with any one of the plurality of coupling parts and a releasing position in which the stopper is released from the coupling part, and a releasing member which is coupled with the second casing to move in the sliding direction in connection with the second casing and is moved by an external force applied thereto in the sliding direction to allow the stopper to move to the releasing position from the coupling position.

The releasing position may include a first releasing position and a second releasing position each corresponding to a first side and a second side of the guide member which are spaced from the central area of the guide member in the transverse direction.

The releasing member may include a manipulation part to which the external force is applied; and a stopper guide part which is provided to the manipulation part to guide the stopper from the coupling position to the releasing position.

The stopper guide part may include a guide groove which crosses the sliding direction at an acute angle.

The manipulation part may include a base plate; a flange part which extends from the base plate towards the second casing; and a bent part which is bent from the flange part in the transverse direction.

The second casing may include a bent part inserting hole through which the bent part is inserted; a sliding groove in which the flange part moves in the sliding direction; and a stopper inserting hole in which the stopper is accommodated.

The stopper inserting hole may include an elongated hole formed along the transverse direction to regulate a movement of the stopper.

The manipulation part may move relative to the second casing in the sliding direction, with respect to the stopper inserting hole.

The second casing may further include a plurality of elastic member holders spaced apart from the stopper inserting hole in the transverse direction.

The releasing member may further include a plurality of elastic member supports spaced apart from opposite sides of each elastic member holder along the sliding direction.

The printing medium feeding cassette may further include a plurality of elastic members arranged between each elastic member holder and the plurality of elastic member supports to elastically bias the manipulation part so that the stopper is located in the coupling position.

The manipulation part may receive therein the guide member and may be coupled with the second casing to move in the sliding direction.

The cassette may further include an elastic member to elastically bias the manipulation part so that the stopper is located in the coupling position.

A distance between the manipulation part and the guide member may gradually increase toward the releasing position from the coupling position.

The manipulation part may include approximately an 'M' shaped section.

The guide member may include a curved shape which is convex at the central area.

The guide member, the stopper, and the releasing member may be installed on at least one of opposite side walls of the first and second casings.

The foregoing and/or other aspects and utilities may be achieved by providing by an image forming apparatus including a printing medium feeding cassette which includes a first casing which comprises a guide member which extends along a sliding direction, and a plurality of coupling parts arranged in a central area of the guide member to be spaced apart from each other along the sliding direction, a second casing which forms a printing medium containing space in cooperation with the first casing to slide along the guide member, a stopper to reciprocate in a direction transverse to the sliding direction between a coupling position in which the stopper is coupled with any one of the plurality of coupling parts and a releasing position in which the stopper is released from the coupling part, and a releasing member coupled with the second casing to move in the sliding direction in connection with the second casing and to be moved by an external force applied thereto in the sliding direction to allow the stopper to move to the releasing position from the coupling position, and an image forming unit to form an image on a printing medium loaded on the printing medium feeding cassette.

The foregoing and/or other aspects and utilities may also be achieved by providing by a printing medium feeding cassette usable with an image forming apparatus which includes a first casing having a plurality of coupling parts coupled to a second casing to define a print medium containing space, the first casing movable along a first direction, a stopper configured to move between a plurality of positions along a second direction, and a releasing member configured to move with the second casing along the first direction to thereby move the stopper to a first position wherein the stopper is coupled to at least one of the plurality of coupling parts and to a second position wherein the stopper is spaced apart from the plurality of coupling parts.

The first casing may move with respect to the second casing such that a length of the printing medium containing space may change.

The first casing may further comprise a guide member which extends in the first direction and includes the plurality of coupling parts disposed on a central portion thereof.

The plurality of coupling parts may be spaced apart from each other along the first direction to correspond with a size of a printing medium.

The second position of the stopper may be spaced apart from the first position of the stopper along the second direction.

A distance between the releasing member and the first casing may increase from the first position of the stopper toward the second position of the stopper.

The printing medium feeding cassette and the image forming apparatus as configured above has the following effects.

In exemplary embodiments, a user can conveniently adjust the size of the printing medium feeding cassette to be suitable for a printing medium to be loaded therein.

In exemplary embodiments, when a user wants to change the size of the printing medium, he or she only has to push or pull the releasing member in the sliding direction to adjust the size of the printing medium feeding cassette.

The foregoing and/or other aspects and utilities may also be achieved by providing by a printing medium feeding cassette usable with an image forming apparatus which includes a first casing having a plurality of coupling parts movably coupled to a second casing to define a print medium containing space, the first casing movable along a first direction, a stopper configured to move between a plurality of positions along a second direction, and a releasing member coupled to move with the second casing along the first direction to thereby move the stopper to a first position where the stopper is coupled to at least one of the plurality of coupling parts and to a second position where the stopper is spaced apart from the plurality of coupling parts.

The first casing may further comprise a guide member which extends in the first direction and includes the plurality of coupling parts disposed on a central portion thereof.

The first casing may move with respect to the second casing such that a length of the printing medium containing space changes.

The plurality of coupling parts may be spaced apart from each other along the first direction to correspond with a size of a printing medium.

The second position of the stopper may be spaced apart from the first position of the stopper along the second direction.

The plurality of coupling parts may include at least one of a groove and a protrusion.

The foregoing and/or other aspects and utilities may also be achieved by providing a printing medium feeding cassette usable with an image forming apparatus which includes a first casing having a plurality of coupling parts, a second casing connectable to the first casing to move along a first direction with respect to the first casing, a releasing member having a groove disposed along a second direction transverse with the first direction, and a stopper member movable along the second direction to be coupled to one of the plurality of coupling parts corresponding to a size of printing medium disposed within a space defined by the first and the second casing.

The stopper member may move away from a first position corresponding to the plurality of coupling parts along the groove when a force is applied to the releasing member along the first direction.

The second casing may further include a stopper inserting hole to transfer the force applied to the releasing member to the stopper member such that the stopper moves along the groove.

The plurality of coupling parts may be disposed along a central portion of the first casing along the first direction.

The groove may guide the stopper member to a second position away from the central portion of the first casing where the stopper is released from the plurality of coupling parts so that the second casing moves with respect to the first casing to accommodate a different size printing medium.

BRIEF DESCRIPTION OF THE DRAWINGS

The above and/or other features and utilities of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
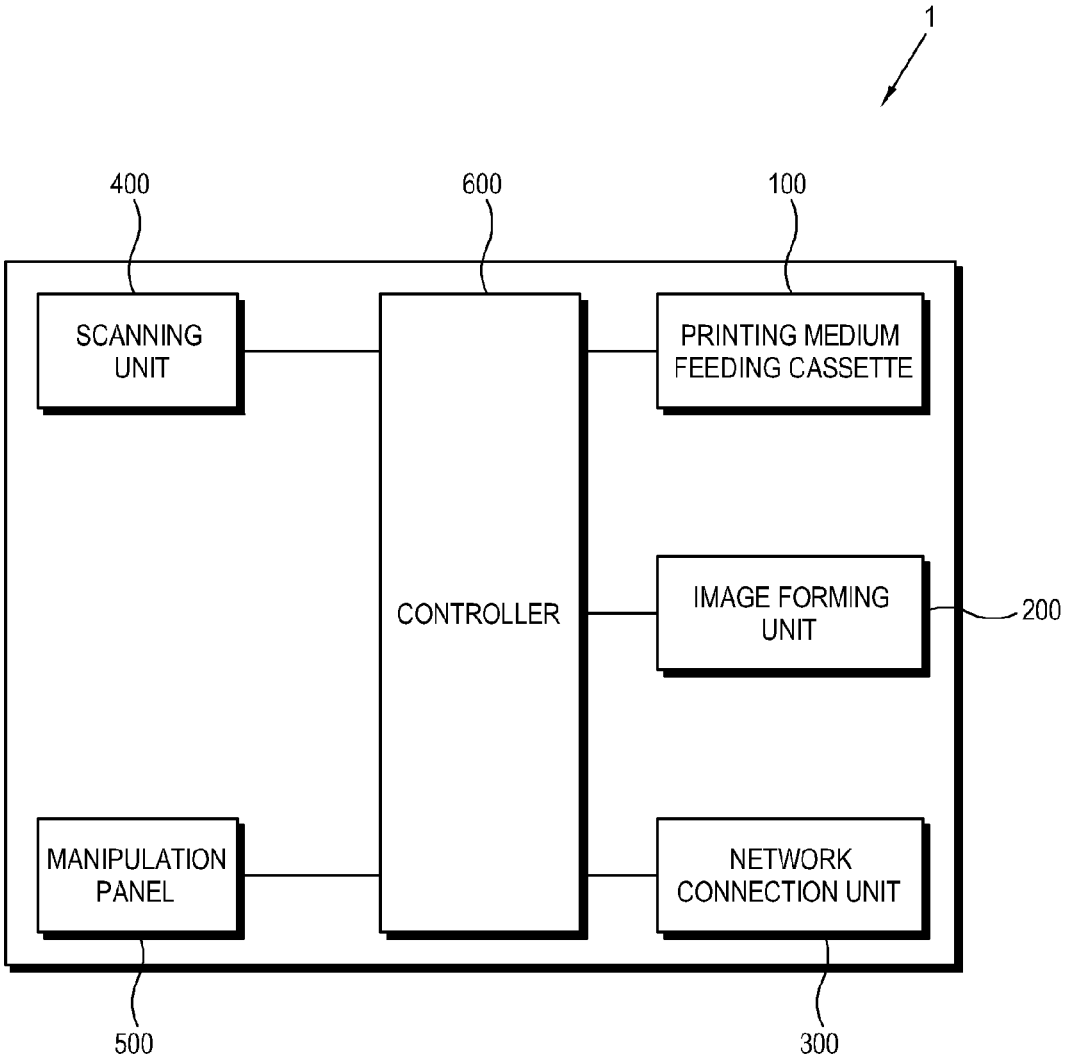
FIG. 1 is a block diagram illustrating an image forming apparatus according to an exemplary embodiment of the present general inventive concept.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

FIG. 1 is a block diagram illustrating an image forming apparatus 1 according to an exemplary embodiment of the present general inventive concept. As illustrated in FIG. 1, the image forming apparatus 1 according to the present exemplary embodiment includes an apparatus main body 2 (see FIG. 10), a printing medium feeding cassette 100 which can be detachably coupled with the apparatus main body 2, an image forming unit 200 which forms an image on a printing medium supplied from the printing medium feeding cassette 100, a network connection unit 300 which receives printing data corresponding to an image which is to be formed on the printing medium, a scanning unit 400 which scans an image in an original document, a manipulation panel 500 which receives a scanning command, a printing command and a controlling command, and a controller 600 which controls the image forming unit 200, the scanning unit 400, and the manipulation panel 500.

In this respect, the network connection unit 300, the scanning unit 400, and the manipulation panel 500 may be selectively provided to the image forming apparatus 1, and thus, one or more of them may be omitted for convenience of design.

In exemplary embodiments, the network connection unit 300 may include a network interface card, and the scanning unit 400 may include an image sensor (not illustrated) such as a Charge Coupled Device (CCD) or a Complementary Metal Oxide Semiconductor (CMOS) image sensor.

The manipulation panel 500 may include an input key (not illustrated) to input the scanning command, the printing command, or the controlling command, and a display panel (not illustrated) to display the command input through the input key and an operational state corresponding to the input command.

The image forming unit 200 may employ at least one of an inkjet type, which ejects ink droplets through nozzles to form an image, an electro-photographic type, which forms an image through the processes of charging, exposure, development, transfer, fixing and cleaning, and a thermal transfer type, which forms an image by using a thermal printing head.

In an exemplary embodiment, in a case of the inkjet type, the image forming unit 200 includes an ink chamber in which ink is stored, a heater which is disposed inside of the ink chamber to heat the ink, and a nozzle plate which is provided with a plurality of nozzles to eject the ink heated by the heater. However, the present general inventive concept is not limited thereto. That is, in alternative exemplary embodiments, the heater may be replaced with a piezoelectric element.

As illustrated in FIGS. 2 to 6, the printing medium feeding cassette 100 according to the present exemplary embodiment includes a first casing 110, a second casing 120 which is configured to slide in a sliding direction A, a stopper 130 which is selectively coupled with part of the first casing 110 to regulate a movement of the second casing 120 along the sliding direction A, and a releasing member 140 which can release the stopper 130 from the first casing 110 according to an external force applied along the sliding direction A.

The first casing 110 and the second casing 120 cooperates with each other to form a printing medium containing space S (see FIG. 5) in which a printing medium (not illustrated) can be contained.

Figure 4A:
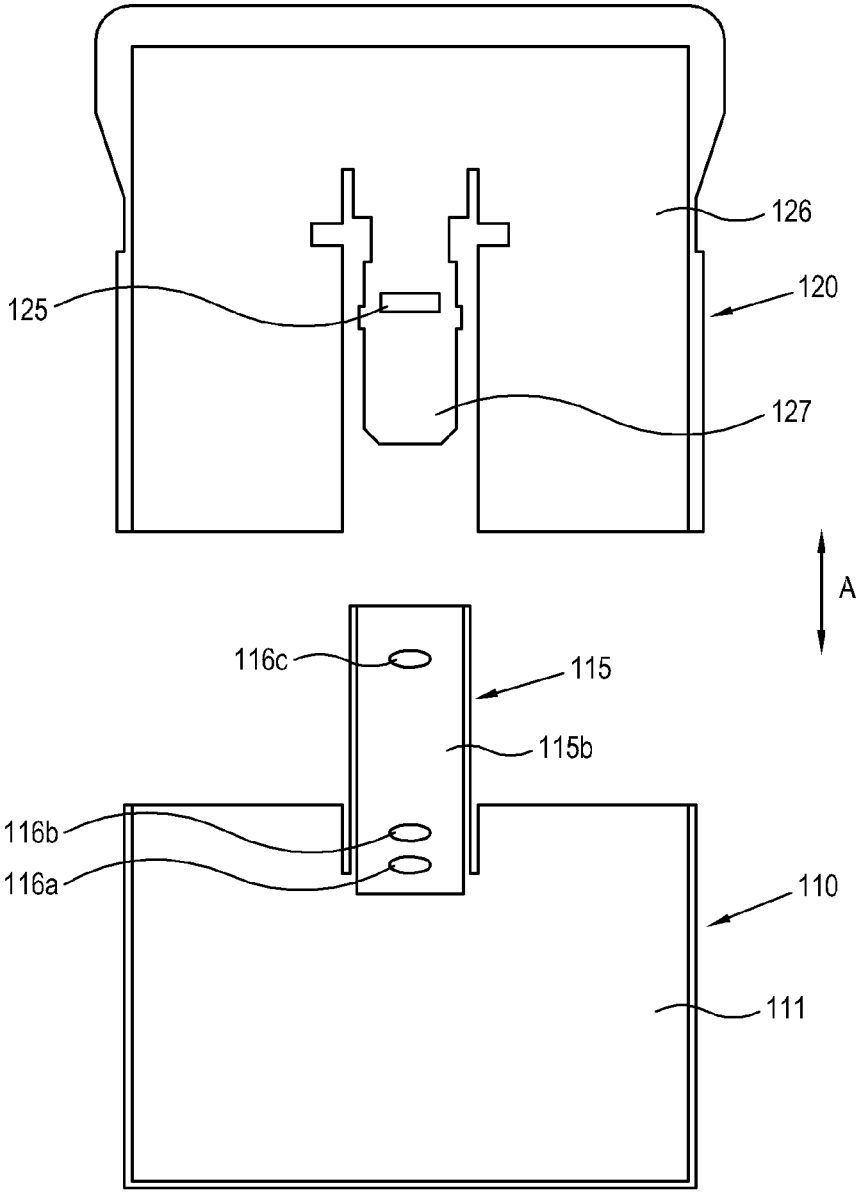
FIGS. 4A through 4D illustrate an assembly of a first casing with a second casing according to an exemplary embodiment of the present general inventive concept.
Figure 4B:
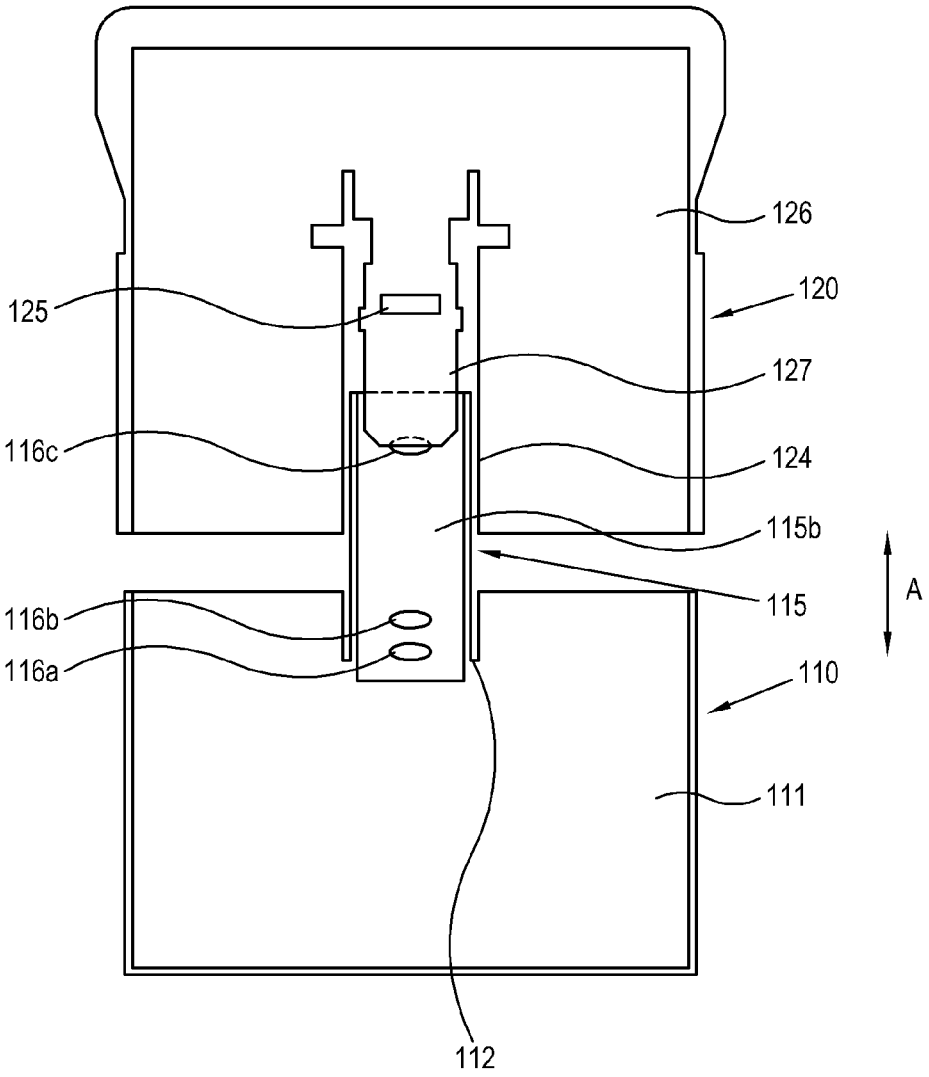
Figure 4C:
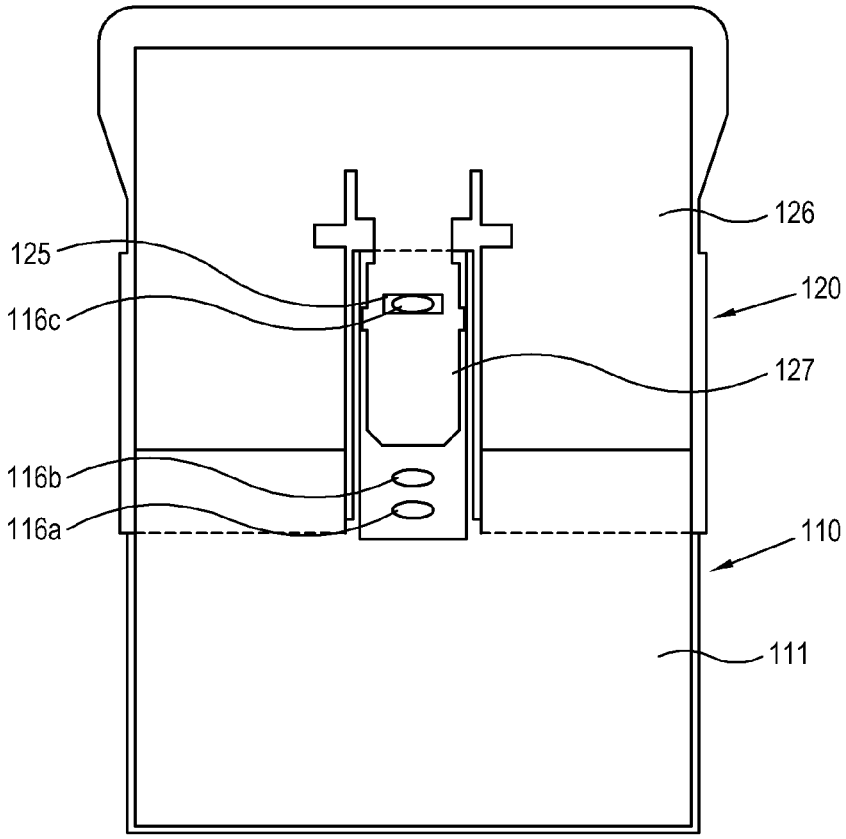
Figure 4D:
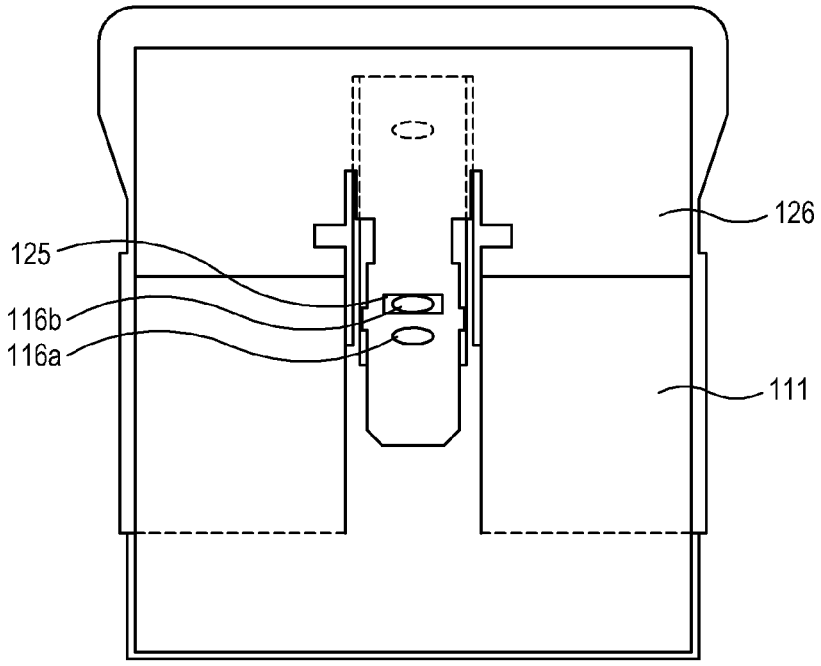

FIGS. 4A through 4B illustrates an assembly of a first casing 110 with a second casing 120 according to an exemplary embodiment of the present general inventive concept.

The first casing 110 includes a base support 111 which supports the printing medium; and a first guide member 115 which extends from the base support 111 in the sliding direction A.

When the first and second casings 110 and 120 are combined with each other (see FIGS. 4A through 4D), the base support 111 of the first casing 110 is disposed above a base support 126 of the second casing 120. In an exemplary embodiment, the first casing 110 having a relatively small width is received inside of the second casing 120 having a relatively large width so that the second casing 120 can slide with respect to the first casing 110. In an alternative exemplary embodiment, the second casing 120 may have a smaller width than the first casing 110, so that the second casing 120 can be received inside of the first casing 110.

Figure 10:
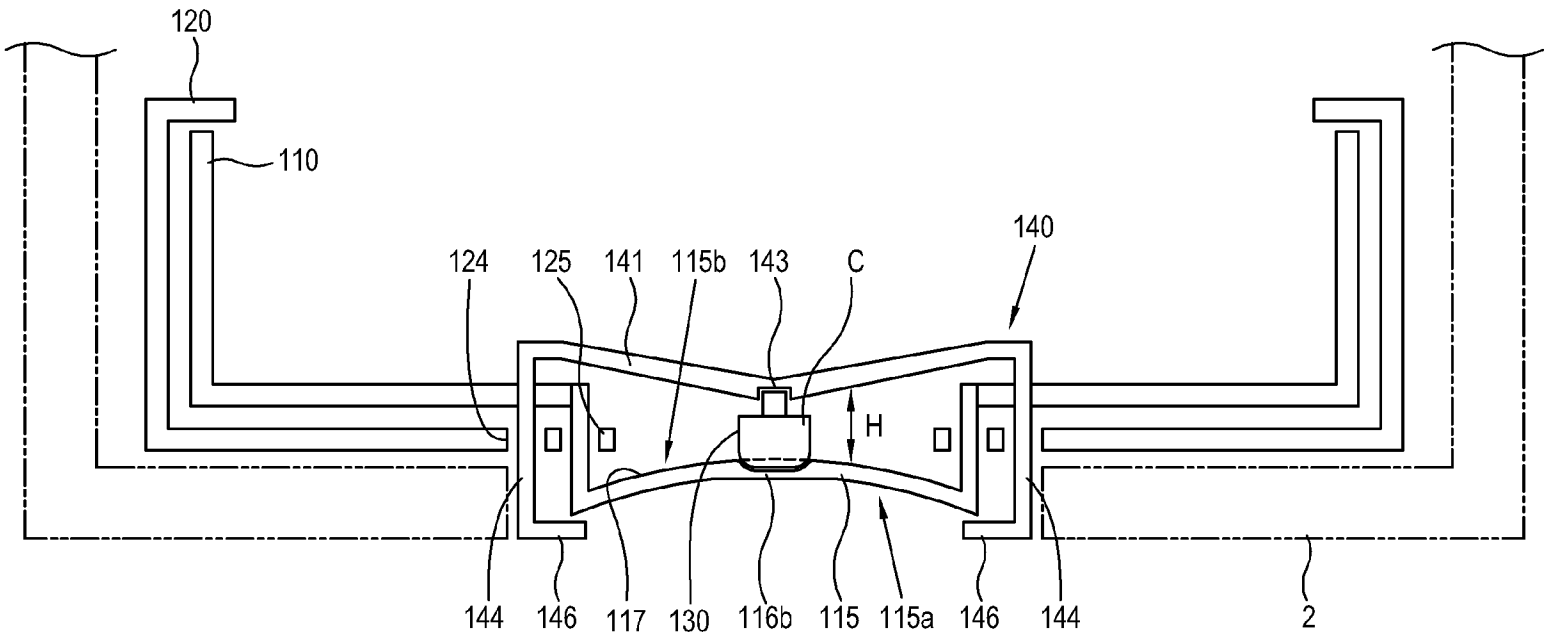
FIG. 10 is a schematic cross section view illustrating the printing medium feeding cassette illustrated in FIG. 9.

The first guide member 115 may be recessed in a direction downward from the base support 111 and may extend in the sliding direction A. In exemplary embodiments, as illustrated in FIG. 10, a bottom surface 115*a* of the first guide member 115 may include a concave shape. As the first casing 110 is combined with the second casing 120, the first guide member 115 of the first casing 110 is disposed below a second guide member 127 of the second casing 120 (see FIG. 4B).

In exemplary embodiments, the first casing 110 may further include a plurality of coupling parts 116 formed in the first guide member 115 along a lengthwise direction of the first guide member 115, that is, along the sliding direction A.

Figure 2:
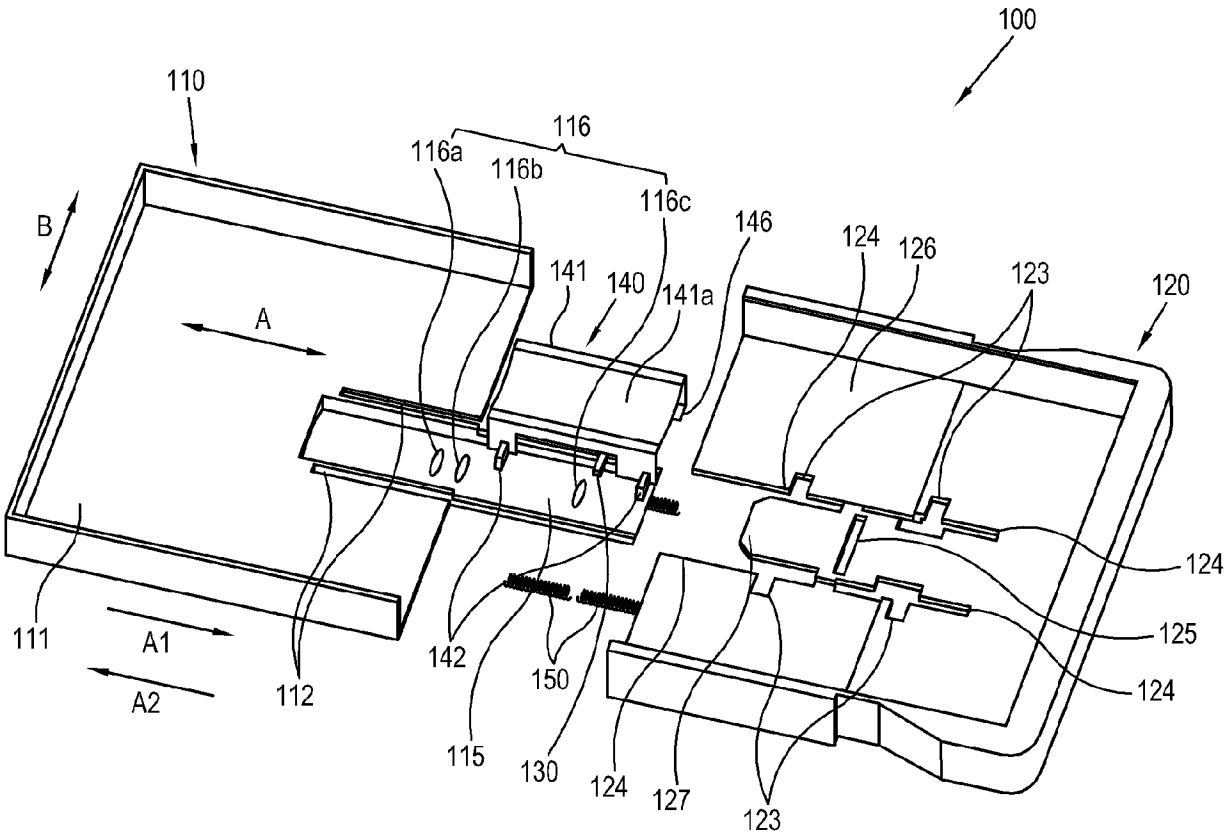
FIG. 2 is an exploded top perspective view illustrating a printing medium feeding cassette of the image forming apparatus illustrated in FIG. 1.

As illustrated in FIG. 2, the plurality of coupling parts 116 may be provided along a central area along a widthwise direction of the first guide member 115 and may be spaced apart from each other. More specifically, in a case that the stopper 130 is located in the central area of the first guide member 115, the stopper 130 can be contacted and coupled with any one of the plurality of coupling parts 116. In the case that the stopper 130 is shifted from the central area to any one side of the first guide member 115, the stopper 130 loses contact with the coupling part 116 and would thereby be released from the coupling part 116.

The plurality of coupling parts 116 may be provided as grooves or protrusions. However, the present general inventive concept is not limited thereto. That is, in exemplary embodiments, the coupling parts may be provided in various shapes which correspond to a shape of the stopper 130 to allow the stopper 130 to be coupled to the coupling parts 116 of the first guide member 115.

The plurality of coupling parts 116 may include a first coupling part 116*a*, a second coupling part 116*b*, and a third coupling part 116*c*, when viewed from the side of the first casing 110. In this respect, a number of the coupling parts 116 may be varied depending on a size of printing mediums to be loaded within the printing medium containing space S. That is, the number of coupling parts 116 disposed on the first guide member 115 may increase as a size of the printing medium to be contained within the printing medium containing space S increases.

In exemplary embodiments, the first casing 110 may further include a plurality of sliding grooves 112 which may be formed in the base support 111 adjacent to opposite sides of the first guide member 115.

When the first and second casings 110 and 120 are combined with each other, the plurality of sliding grooves 112 corresponds to and communicates with sliding grooves 124 of the second casing 120 (see FIG. 4B). Thus, the releasing member 140 may reciprocate in the sliding direction A along the sliding grooves 112 and 124 of the first and second casings 110 and 120.

In exemplary embodiments, the second casing 120 includes the base support 126 which supports a printing medium; the sliding grooves 124 which guides a sliding movement of the releasing member 140 along the sliding direction A; and a bent part inserting hole 123 which are formed in the base support 126 of the second guide member 127.

In exemplary embodiments, flange parts 144 of the releasing member 140, which will be described later, may be inserted into the sliding grooves 124.

The sliding grooves 124 may be disposed adjacent to opposite sides of the second guide member 127 along the sliding direction A. That is, the second guide member 127 may be disposed between the sliding grooves 124, and may face the first guide member 115 of the first casing 110 when the first and second casings 110 and 120 are combined with each other. That is, referring to FIGS. 2, 3, and 10, a bottom surface 127*a* of the second guide member 127 may face a top surface 115*b* of the first guide member 115 when the first and second guide casings 110 and 120 are combined.

The second guide member 127 includes a stopper inserting hole 125 through which the stopper 130 may be inserted. As illustrated in FIG. 2, the stopper inserting hole 125 may be provided as an elongated hole (i.e., a slot) which is formed in a direction transverse to the sliding direction A. In exemplary embodiments, the stopper inserting hole 125 may contact the stopper 130 to apply a force to the stopper 130.

The stopper 130 may reciprocate between a coupling position C (see FIG. 10) in which the stopper 130 may be contacted and coupled with any one of the coupling parts 116 arranged in a central area of the first guide member 115 and releasing positions D and E (see FIG. 16 and FIG. 13) in which the stopper 130 is shifted from the central area of the first guide member 115 in a transverse direction B and is released from the coupling parts 116. The stopper 130 can be accommodated in the stopper inserting hole 125 of the second guide member 127 of the second casing 120, and thus, the stopper 130 may be regulated to move in the transverse direction B. That is, in exemplary embodiments, the stopper 130 may move due to a force applied from the stopper inserting hole 125.

The releasing positions D and E refer to positions where the stopper 130 moves to the opposite sides of the first guide member 115 from the central area thereof in the transverse direction B. As illustrated in FIG. 8A, the stopper 130 includes a stopper main body 133, and a protrusion 131 which is inserted into a stopper guide part 143 (see FIG. 7). In exemplary embodiments, sides and corners of a bottom of the stopper main body 133 may be rounded to slide easily with respect to an upper surface of the first guide member 115.

Figure 8A:
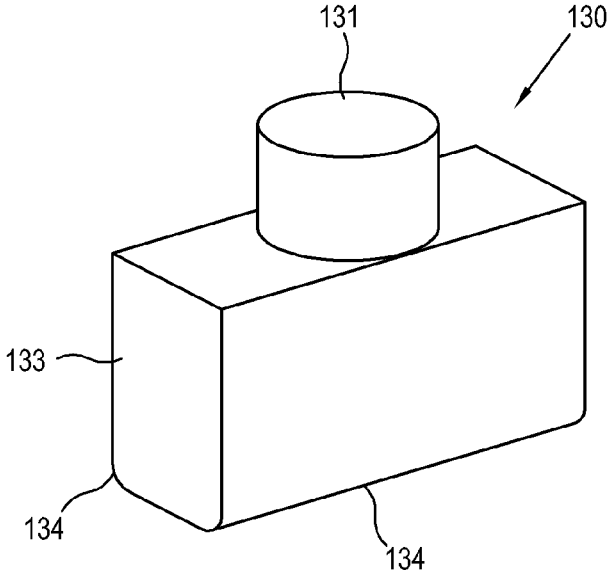
FIG. 8A is an enlarged schematic view illustrating the stopper of the printing medium feeding unit illustrated in FIG. 2.
Figure 8B:
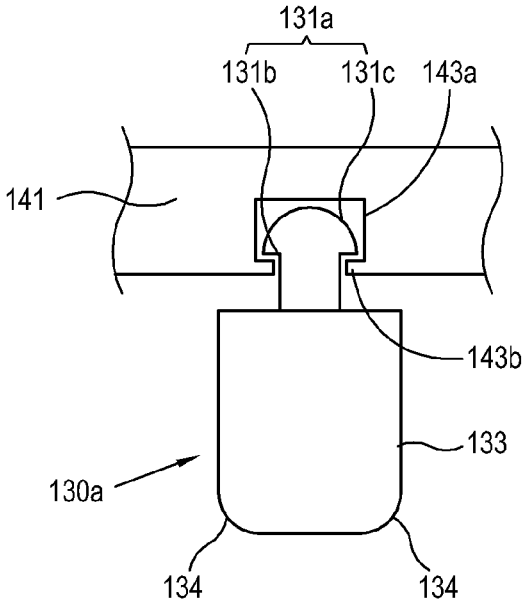
FIG. 8B is an enlarged schematic view illustrating a modified example of the stopper illustrated in FIG. 8A.

FIG. 8B illustrates an exemplary embodiment of a modified stopper 130*a*. As illustrated in FIG. 8B, the modified stopper 130*a* includes a modified protrusion 131*a*. The modified protrusion 131*a* includes a suspension part 131*b* and a round part 131*c*. A modified stopper guide part 143*a* includes a deviation prevention part 143*b* corresponding to the suspension part 131*b*. That is, the suspension part 131*b* can be suspended on the deviation prevention part 143*b*. Thus, the stopper 130*a* may be prevented from being deviated in a direction away from the manipulation part 141 (i.e., downwards). With this configuration, the stopper 130*a* can be stably supported by the manipulation part 141, while moving along the stopper guide part 143*a*.

In exemplary embodiments, when the protrusion 131*a* is inserted into the stopper guide part 143*a*, the protrusion 131*a* may smoothly pass through the deviation prevention part 143*b* by means of the round part 131*c*. To this end, the stopper 130*a* and the manipulation part 141 may be made of plastic having flexibility. However, the present general inventive concept is not limited thereto. That is, in exemplary embodiments, the stopper 130*a* and the manipulation part 141 may be formed of various materials, including metals, which are coated with materials, such as silicone or Teflon™, to reduce a friction between the stopper 130*a* and the manipulation part 141.

Figure 7:
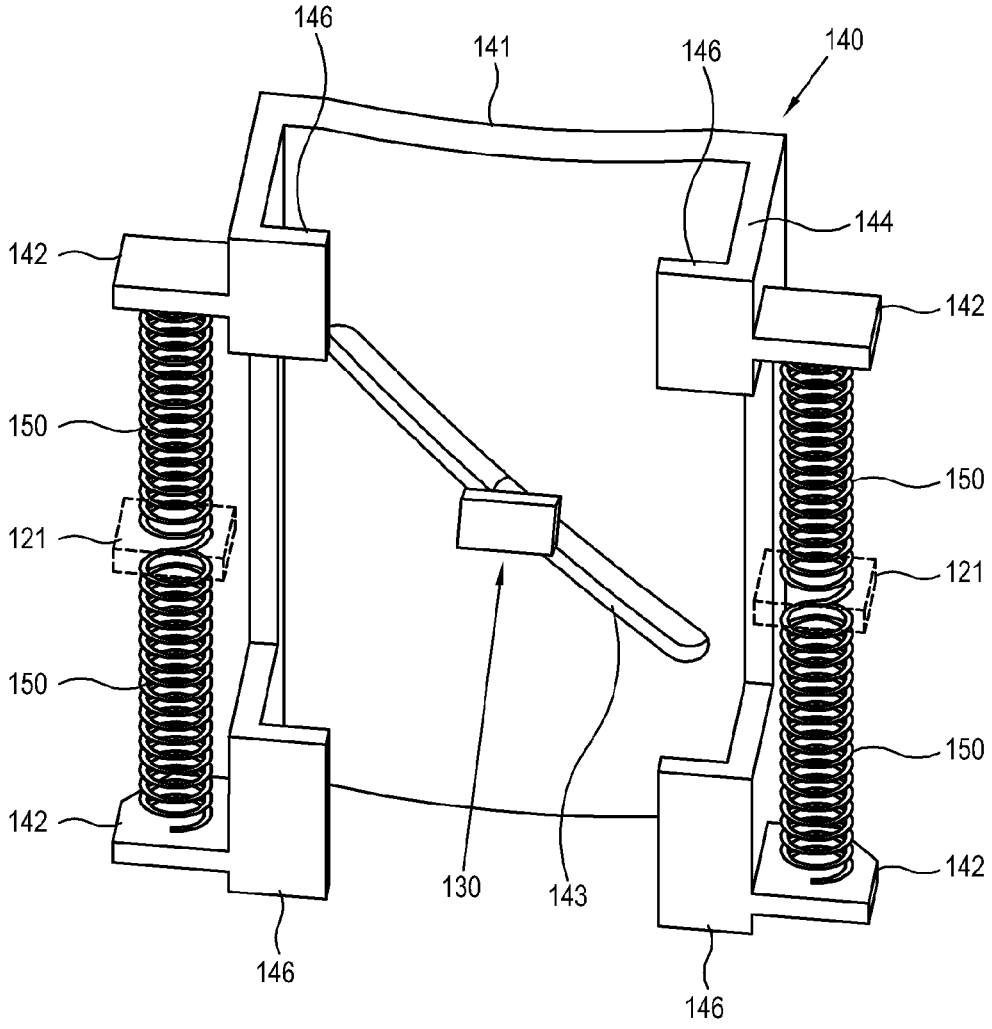
FIG. 7 is a bottom perspective view illustrating a stopper and a releasing member of the printing medium feeding cassette illustrated in FIG. 2.

As illustrated in FIG. 7, the releasing member 140 includes the manipulation part 141 which is exposed outside of the printing medium feeding cassette 100 and receives an external force applied in the sliding direction A, and the stopper guide part 143 which guides the stopper 130 between the coupling position C and the releasing positions D and E. In exemplary embodiments, an upper surface of the manipulation part 141 may be planar with the base support 111 of the first casing 110 and/or the base support 126 of the second casing 120.

In exemplary embodiments, the releasing member 140 may be integrally formed from a single piece of material. That is, in exemplary embodiments, the manipulation part 141 may be integrally formed with the elastic member supports 142, the flange part 144, and the bent part 146.

In exemplary embodiments, when an external force is applied to the manipulation part 141 in the sliding direction A, the releasing member 140 may move in the sliding direction A together with the second casing 120. More specifically, since an elastic member holder 121 which can be attached to a rear surface of the second casing 120 is connected with the releasing member 140 through elastic members 150, to be described later, the releasing member 140 may move in the sliding direction A together with the second casing 120, when an external force exceeding an elastic force of the elastic members 150 is applied to the manipulation part 141.

In exemplary embodiments, a bent part 146 of the releasing member 140 may be coupled with an edge of a bent part inserting hole 123 of the second casing 120, so that the releasing member 140 and the second casing 120 may move in connection with each other.

Figure 11:
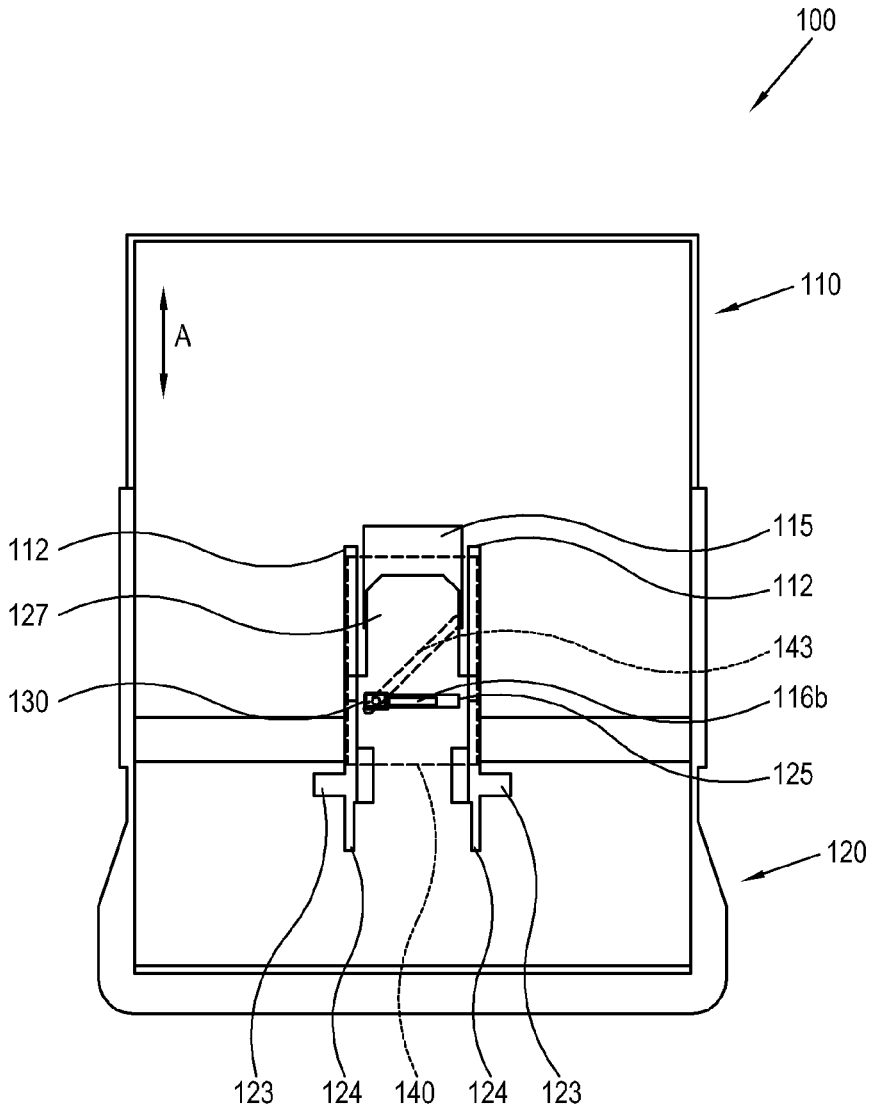
FIG. 11 is a plan view illustrating the printing medium feeding cassette illustrated in FIG. 9, in a state that the releasing member is pushed.
Figure 15:
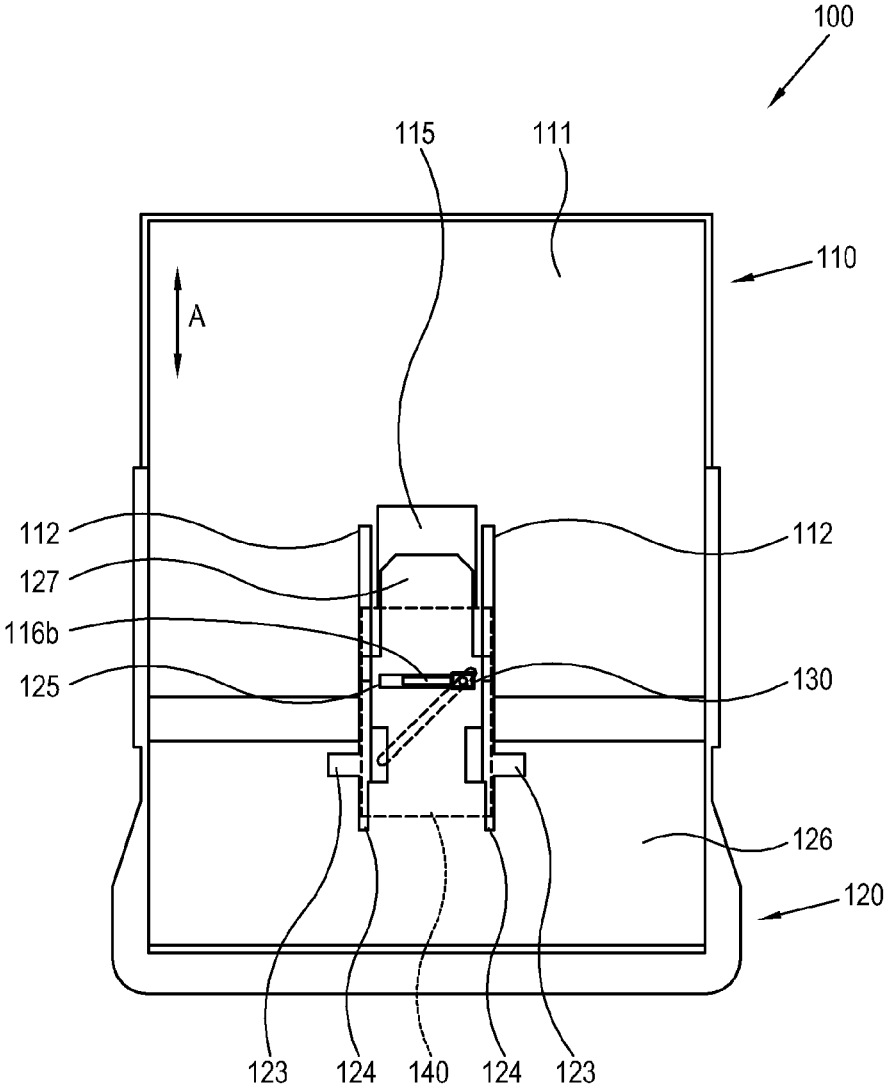
FIG. 15 is a plan view illustrating the printing medium feeding cassette illustrated in FIG. 9, in a state that the releasing member is pulled.

As illustrated in FIGS. 11 and 15, the releasing member 140 may reciprocate along the sliding direction A with respect to the second casing 120, with reference to the stopper inserting hole 125.

Figure 12A:
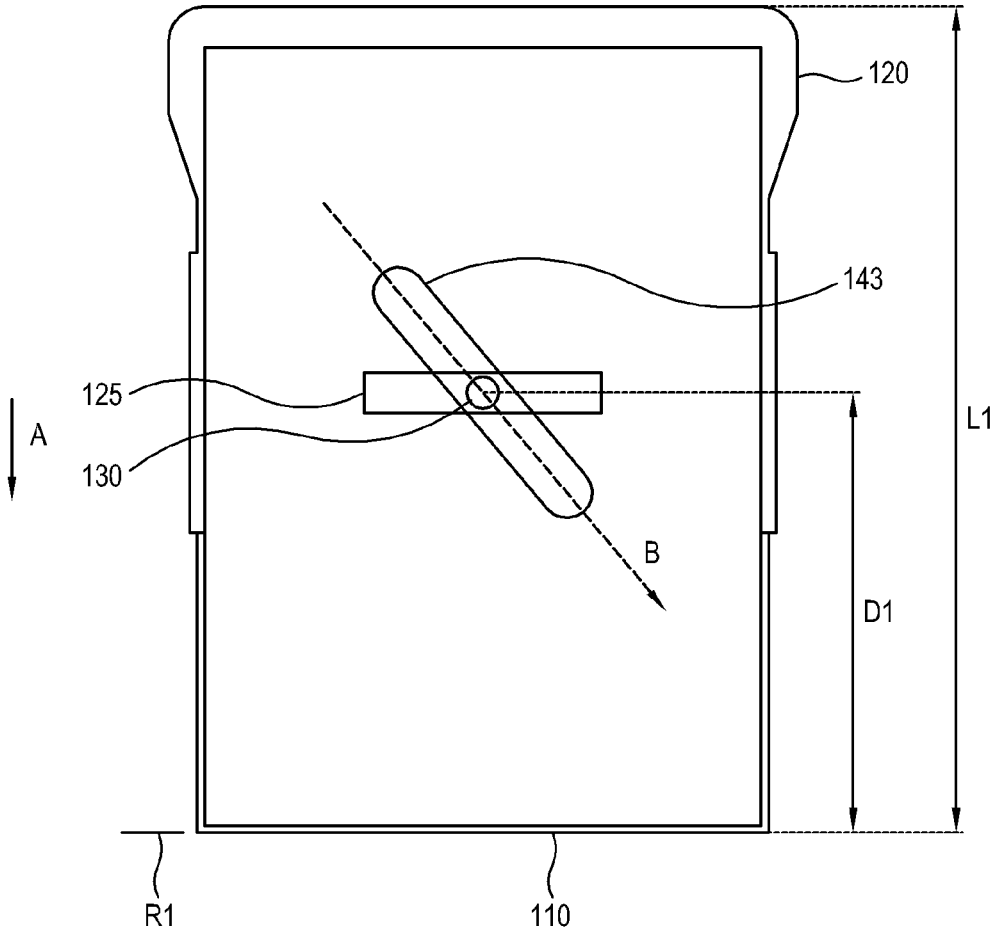
FIGS. 12A through 12C illustrate a relationship between a second casing, a manipulation part, and a stopper with respect to a first casing according to an exemplary embodiment of the present general inventive concept.
Figure 12B:
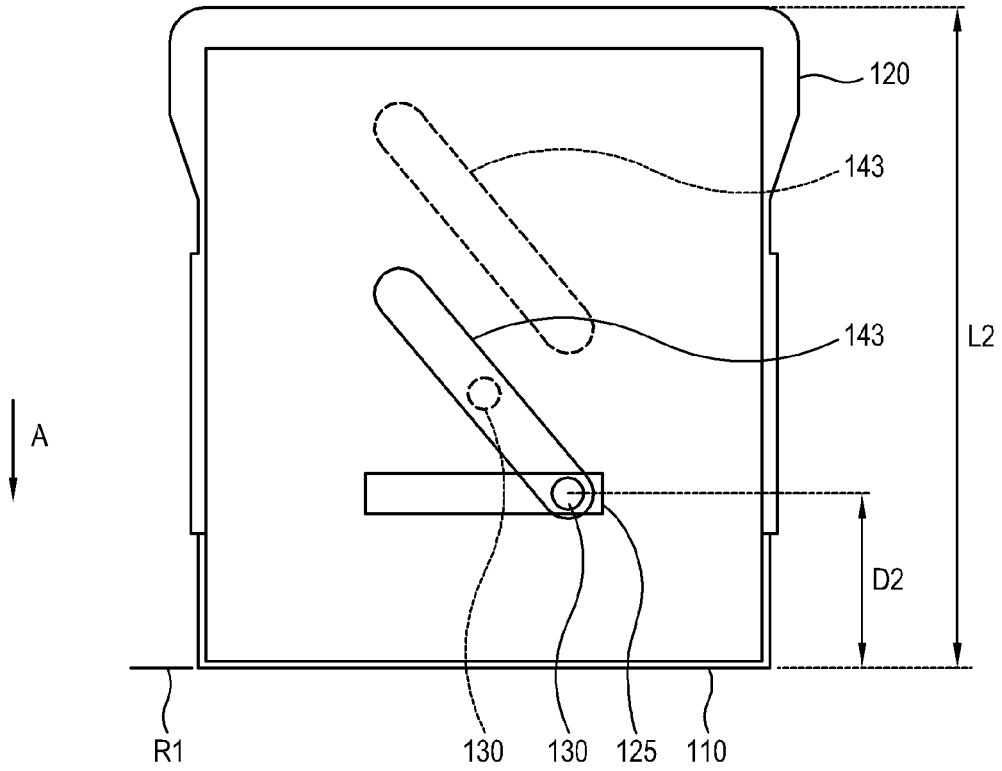
Figure 12C:
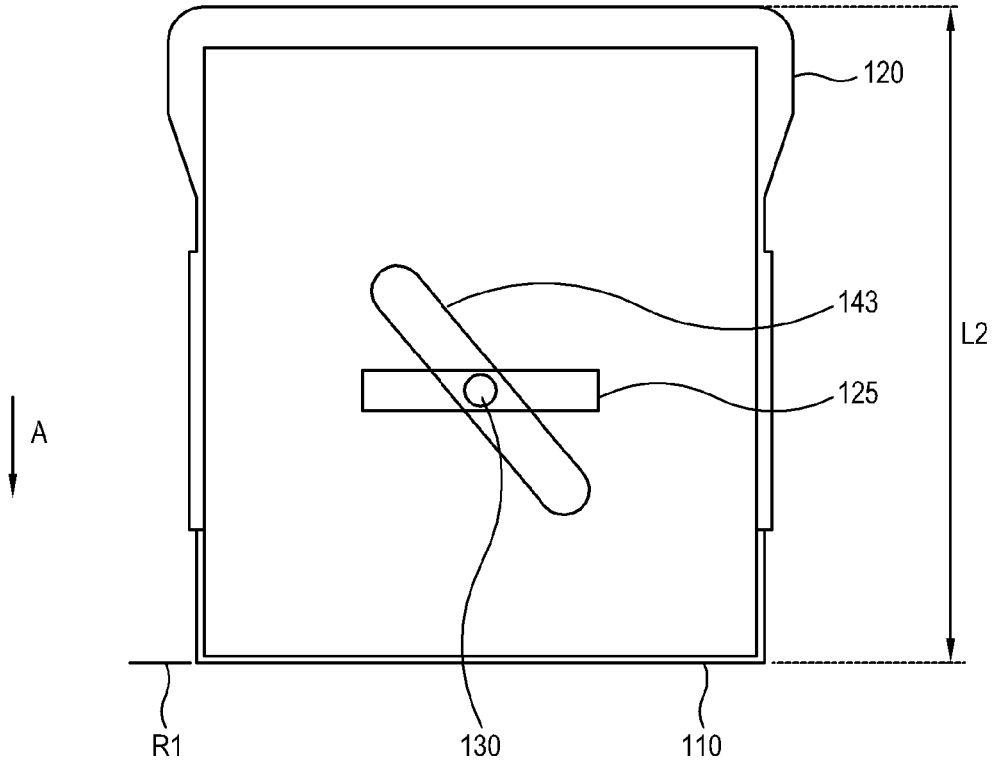

FIGS. 12A through 12C illustrate an exemplary embodiment of a relationship of the second casing 120 with respect to the first casing 110. As illustrated in FIG. 12A, a first length L1 of the second casing 120 with respect to a reference line R1 of the first casing 110 may accommodate a first size of printing medium, such as an A4 size. When a force is applied to the manipulation part 140 along the A direction toward the first casing 110, the stopper inserting hole 125 of the second casing 120 may move with the manipulation part 140 when the force is greater than a second force exerted by the elastic members 150. The movement of the second casing 120, in turn, forces the stopper inserting hole 125 to cause the stopper 130 to move along a second B direction, which traverses the A direction. In exemplary embodiments, the B direction forms an acute angle with respect with the A direction, such that the stopper 130 may move along the B direction, when a force is applied to the stopper 130 along the A direction.

As illustrated in FIG. 12B, the stopper 130" has moved such that a distance D1 between the reference line R1 and a center of the stopper 130 has changed to a distance D2, which is less than the distance D1. As a result, the first length L1 has changed to a distance L2, such that the first casing 110 and the second casing 120 may accommodate a second size of printing medium which is smaller than the first size of printing medium. The stopper inserting hole 125 may force the stopper 130 away from a central portion of the first casing 110, such that the stopper 130 is released from the coupling part 116*c* (see FIG. 4B).

As illustrated in FIG. 12C, when the stopper 130 corresponds to another coupling part, such as 116*b* or 116*a*, the second force exerted by the elastic members 150 moves the manipulation part 140 such that the stopper 130 returns to the central portion of the first casing 110, to thereby be coupled to the coupling part 116, for example.

The manipulation part 141 may receive an external force to pull the second casing 120 in a first direction A1 (see FIG. 9) in which the second casing 120 moves away from the first casing 110. Further, the manipulation part 141 may receive an external force to push the second casing 120 in a second direction A2 (see FIG. 9) in which the second casing 120 moves toward to the first casing 110. The pulling force and the pushing force may be manually applied by a user. However, the present general inventive concept is not limited thereto. That is, in exemplary embodiments, the pulling force and the pushing force may be applied by an electric motor, a pneumatic device, a hydraulic device or the like.

As illustrated in FIGS. 2 and 10, the manipulation part 141 includes an external force acting surface 141*a* to which when an external force is applied, flange parts 144 which are bent from opposite sides of the external force acting surface 141*a* moves towards the second casing 120 and bent parts 146 which are bent from the flange parts 144 move in a transverse direction B of direction A.

In exemplary embodiments, the flange parts 144 of the manipulation part 141 may be inserted into the sliding grooves 112 and 124 of the first and second casings 110 and 120; and the bent parts 146 of the manipulation part 141 may be accommodated in the bent part inserting holes 123 of the second casing 120.

In exemplary embodiments, the stopper guide part 143 may be formed on an inner surface of the manipulation part 141, which faces the second guide member 127 of the second casing 120.

The stopper guide part 143 may include a guide groove which may be formed on the inner surface of the manipulation part 141 in a direction which crosses the sliding direction A at an acute angle. In this respect, as the angle between a lengthwise direction of the guide groove 143 and the sliding direction A is close to 90°, the manipulation part 141 may move a short distance in the sliding direction A to move the stopper 130 from the coupling position to the releasing positions. Contrarily, as the angle between the direction of the guide groove 143 and the sliding direction A is close to 0°, the manipulation part 141 should move a relatively long distance in the sliding direction A to move the stopper 130 from the coupling position to the releasing positions. The angle between the direction of the guide groove 143 and the sliding direction A may be appropriately adjusted in consideration of a movement range of the releasing member 140 or the like.

In the above exemplary embodiment, the stopper guide part 143 can be formed in a shape corresponding to the guide groove 143 by way of example, but the stopper guide part 143 may be formed in a shape of a protrusion having a same profile as that of the guide groove 143. In this case, the stopper 130 may be configured to move along the protrusion.

The printing medium feeding cassette 100 may further include the elastic members 150 which elastically bias the releasing member 140 so that the stopper 130 can be located in a coupling position. In exemplary embodiments, the elastic members 150 may be configured to elastically bias the stopper 130, in place of the releasing member 140.

Figure 3:
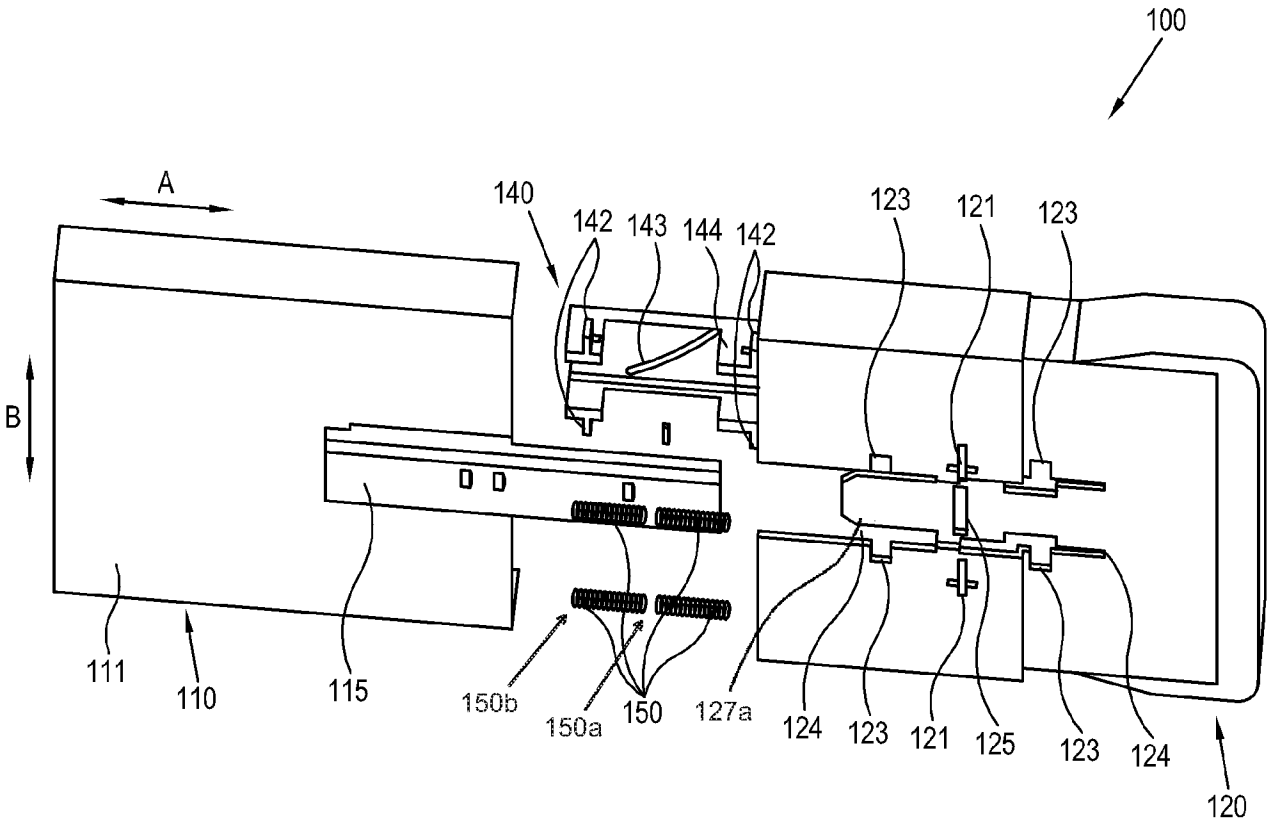
FIG. 3 is an exploded bottom perspective view illustrating the printing medium feeding cassette illustrated in FIG. 2.

As illustrated in FIG. 3, the second casing 120 may further include a plurality of elastic member holders 121 which may be provided on a rear surface of the base support 126. The plurality of elastic member holders 121 can be arranged beside the opposite side parts of the stopper inserting hole 125 along the transverse direction B.

Figure 6:
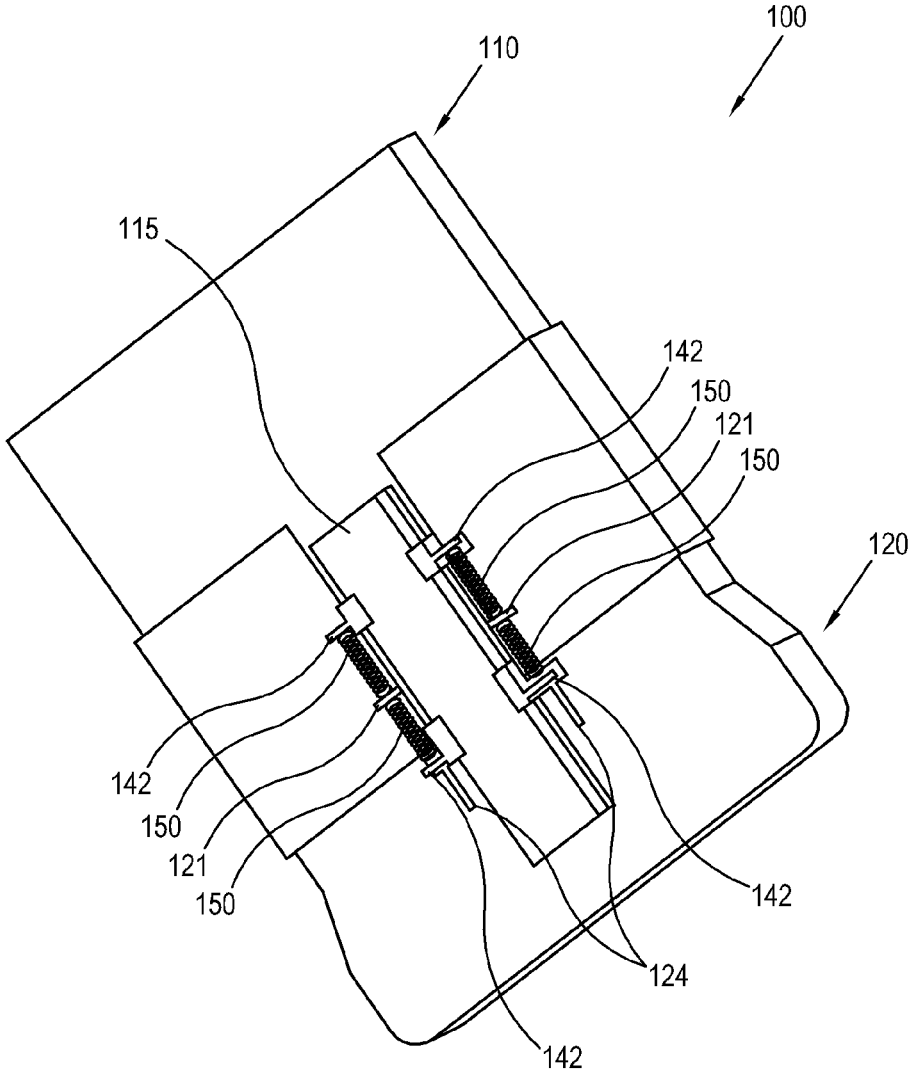
FIG. 6 is a bottom perspective view illustrating the printing medium feeding cassette illustrated in FIG. 2.

As illustrated in FIG. 6, the releasing member 140 further includes a plurality of elastic member supports 142 which is respectively protruded from the flange parts 144. Each pair of the elastic member supports 142 is arranged in the sliding direction A, with each elastic member holder 121 being interposed therebetween. Further, the elastic member supports 142 are arranged adjacent to the opposite sides of the first guide member 115. Thus, as illustrated in FIG. 7, the number of the elastic member supports 142 may be, for example, four to correspond to the four flange parts 144. However, the present general inventive concept is not limited thereto.

As illustrated in FIGS. 3 and 6, each elastic member 150 may be connected with the elastic member holder 121 at one end part 150*a* thereof (i.e., a first end), and may be connected with the elastic member support 142 at the other end part 150*b* thereof (i.e., a second end).

Figure 5:
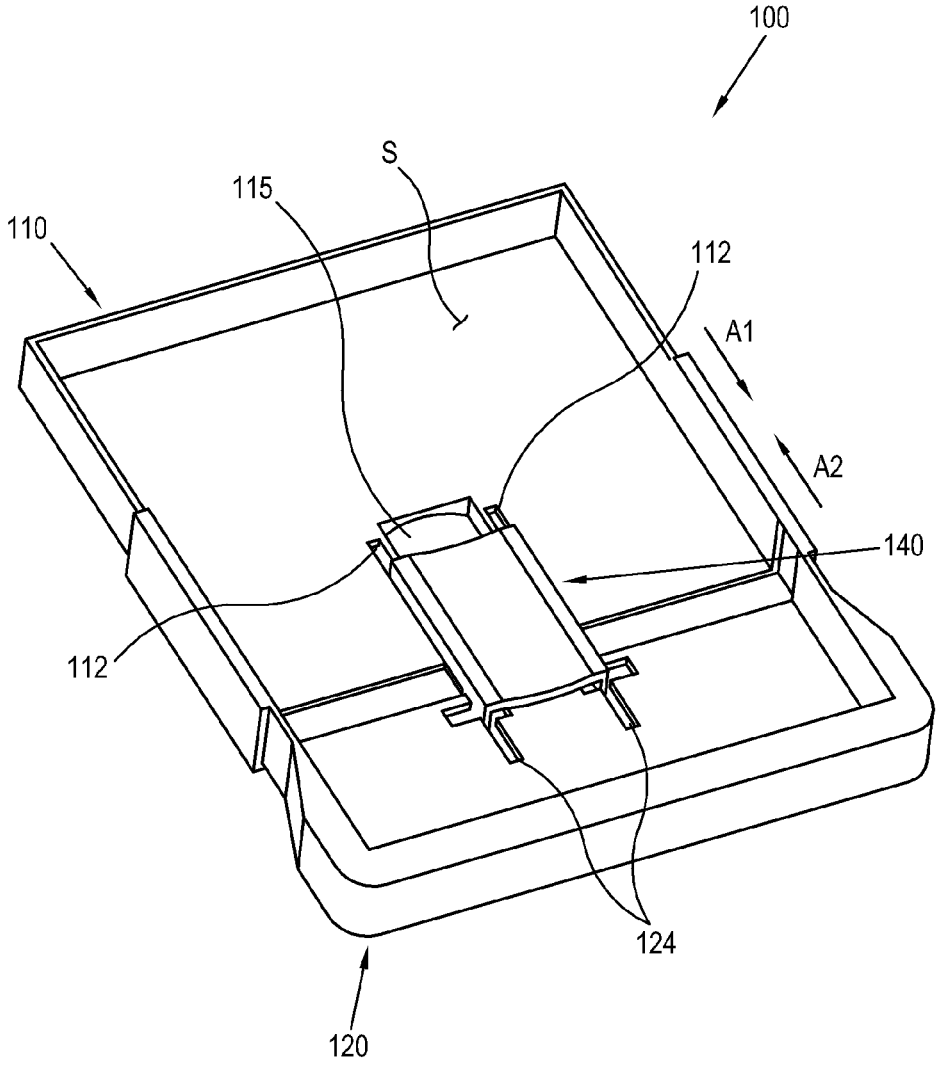
FIG. 5 is a top perspective view illustrating the printing medium feeding cassette illustrated in FIG. 2.

FIGS. 5 and 6 illustrate a state in which the stopper 130 is coupled with the second coupling part 116*b*, so that a printing medium, for example, of an A4 size can be loaded in the printing medium containing space S defined by first and second casings 110 and 120.

Hereinafter, a process of adjusting the printing medium feeding cassette 100 to be suitable for a size of the printing medium to be loaded in the printing medium feeding cassette 100 will be described with reference to FIGS. 9 to 17.

In an exemplary embodiment, it is assumed that the printing medium feeding cassette 100 can load therein at least three different sizes of printing mediums, for example, a letter size (216×279 cm), an A4 size (210×297 cm), and a legal document size (216×356 cm). In this respect, it is assumed that the first coupling part 116*a*, the second coupling part 116*b*, and the third coupling part 116*c* correspond to the letter size, the A4 size and the legal document size, respectively.

Figure 9:
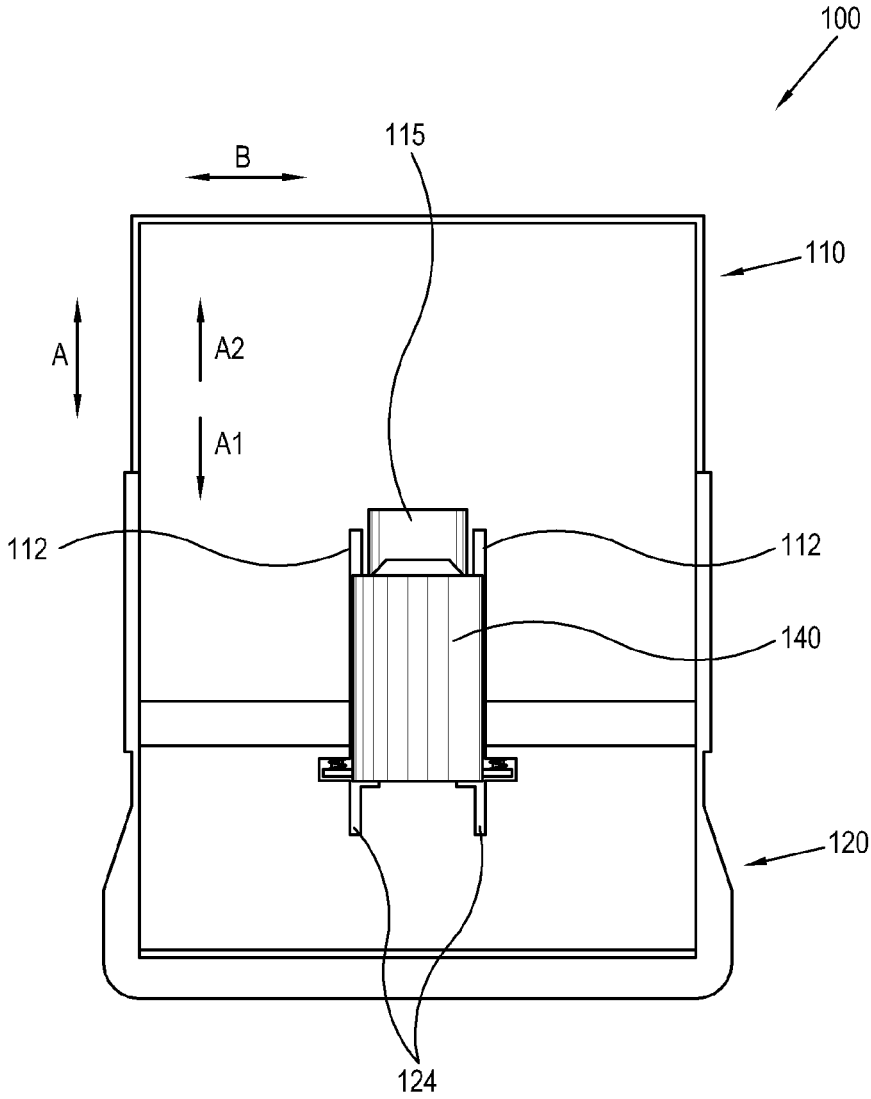
FIG. 9 is a plan view illustrating the printing medium feeding cassette illustrated in FIG. 2, which is set to an A4 size.

FIGS. 9 and 10 are a top plan view and a schematic section view illustrating the state that the stopper 130 is coupled with the second coupling part 116*b* to load the A4 size printing medium. In the state that the stopper 130 is coupled with the second coupling part 116*b*, the first and second casings 110 and 120 maintain coupling to each other to be suitable to contain the A4 printing medium, as long as an external force to release the coupling is not applied to the releasing member 140 in the sliding direction A.

As illustrated in FIG. 10, the manipulation part 141 and the first guide member 115 may be configured so that a distance H between the manipulation part 141 and the first guide member 115 is gradually increased from the coupling position C toward the first and second releasing positions E and D. Accordingly, as the stopper 130 moves from the coupling position C to the releasing position D or E, the stopper 130 becomes gradually spaced apart from the first guide member 115 to thereby be released from the coupling part 116 provided in the first guide member 115.

As illustrated in FIG. 10, the manipulation part 141 may have an 'M' shaped section. However, the present general inventive concept is not limited thereto. Further, the first guide member 115 may be formed to be upwardly convex at central area thereof.

A process of changing the printing medium feeding cassette 100 from the A4 size printing medium as illustrated in FIGS. 9 and 10 to a letter size will be described with reference to FIGS. 11 to 14. In FIG. 11, the releasing member 141 is illustrated by a dashed line for convenience of clarity.

Considering that the letter size is shorter in length than the A4 size, a user pushes the releasing member 140 towards the first casing 110, that is, in the second direction A2, and thus, a pushing force is applied to the releasing member 140.

Figure 13:
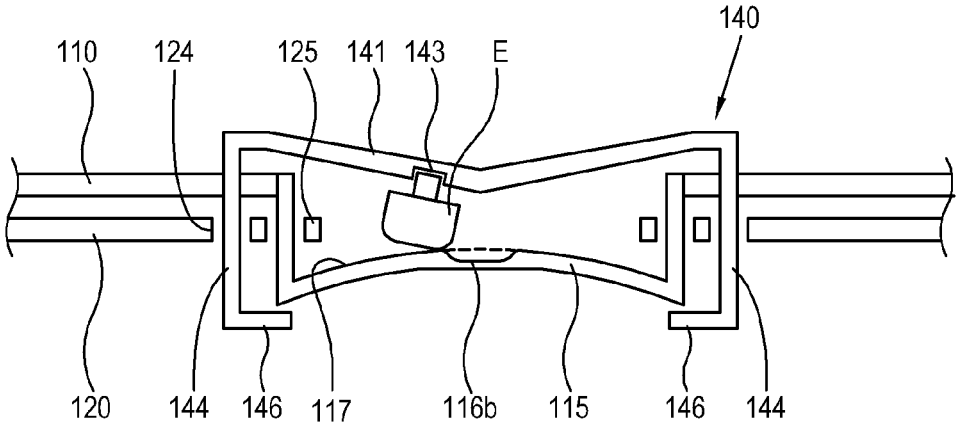
FIG. 13 is a schematic cross section view illustrating the printing medium feeding cassette illustrated in FIG. 11.

As the releasing member 140 moves in the second direction A2, as illustrated in FIGS. 11 and 13, the stopper 130 moves to the first releasing position E from the coupling position C. In this state, a distance between the manipulation part 141 and the first guide member 115 becomes sufficiently increased, and thus, the stopper 130 can be released from the second coupling part 116*b*.

Thereafter, if the user pushes the releasing member 10 further in the second direction A2, the second casing 120 slides in the second direction A2 towards the first casing 110, in the state that the stopper 130 is released from the second coupling part 116*b*. At this time, the stopper 130 also moves in the second direction A2 along an upper guide surface 117 of the first guide member 115.

Figure 14:
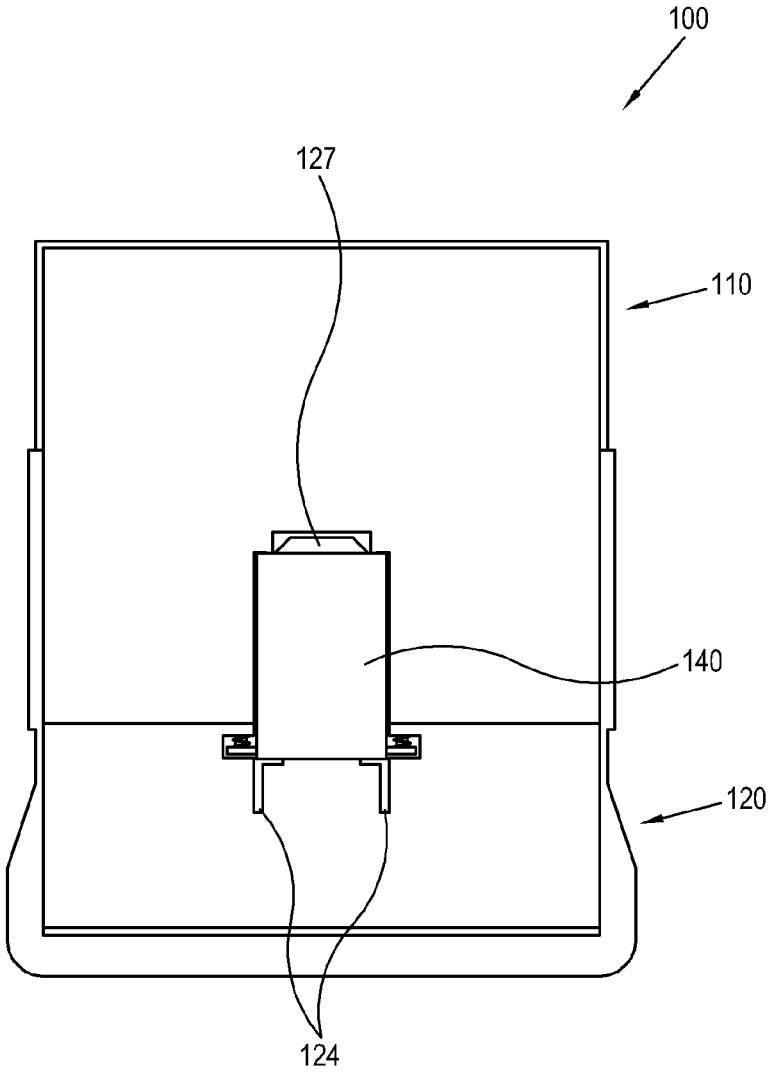
FIG. 14 is a plan view illustrating the printing medium feeding cassette which is set to a letter size by pushing the releasing member illustrated in FIG. 11.

When the stopper 130 reaches a position of the first coupling part 116*a* (see FIG. 2), the elastic members 150 elastically bias the releasing member 140, and thus, the stopper 130 returns to the coupling position C. Thus, the stopper 130 is coupled with the first coupling part 116*a*, and the printing medium feeding cassette 100 is set to be suitable to contain the letter size printing medium, as illustrated in FIG. 14.

Hereinafter, a process of changing the printing medium feeding cassette 100 from the A4 size printing medium, as illustrated in FIGS. 9 and 10, to the legal document size printing medium will be described with reference to FIGS. 15 to 17.

Considering that the legal document size printing medium is longer in length than the A4 size printing medium, the user pulls the releasing member 140 towards the second casing 120 as illustrated in FIG. 15, that is, in the first direction A1.

Figure 16:
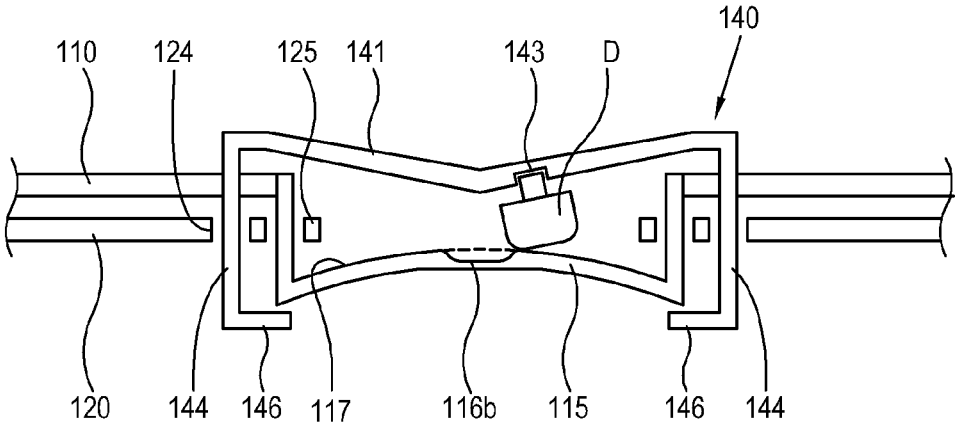
FIG. 16 is a schematic cross section view illustrating the printing medium feeding cassette illustrated in FIG. 15.
Figure 17:
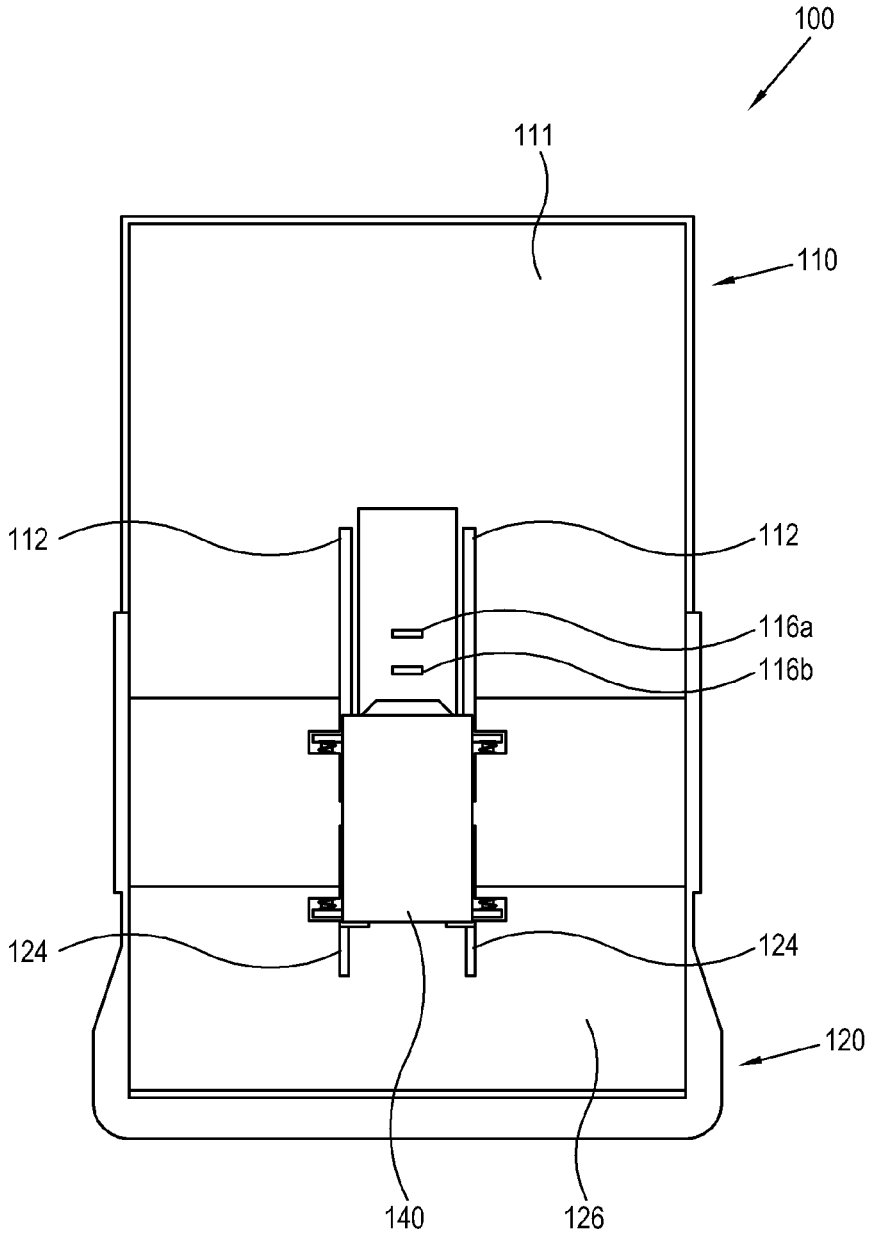
FIG. 17 is a plan view illustrating the printing medium feeding cassette which is set to a legal document size by pushing the releasing member illustrated in FIG. 15.

As the releasing member 140 slides in the first direction A1, the stopper 130 moves to the second releasing position D from the coupling position C, as illustrated in FIGS. 15 and 16. In this state, a distance between the manipulation part 141 and the first guide member 115 becomes sufficiently increased, and thus, the stopper 130 can be released from the second coupling part 116*b*.

Thereafter, if the user pulls the releasing member 10 further in the first direction A1, the second casing 120 slides away from the first casing 110 in the first direction A1, in the state that the stopper 130 is released from the second coupling part 116*b*. At this time, the stopper 130 also moves in the first direction A1 along the upper guide surface 117 of the first guide member 115.

When the stopper 130 reaches the position of the third coupling part 116*c* (see FIG. 2), as the elastic members 150 elastically bias the releasing member 140, the stopper 130 returns to the coupling position C. Thus, the stopper 130 is coupled with the third coupling part 116*c*, and the printing medium feeding cassette 100 is set to be suitable for the legal document size printing medium, as illustrated in FIG. 17.

Figure 18:
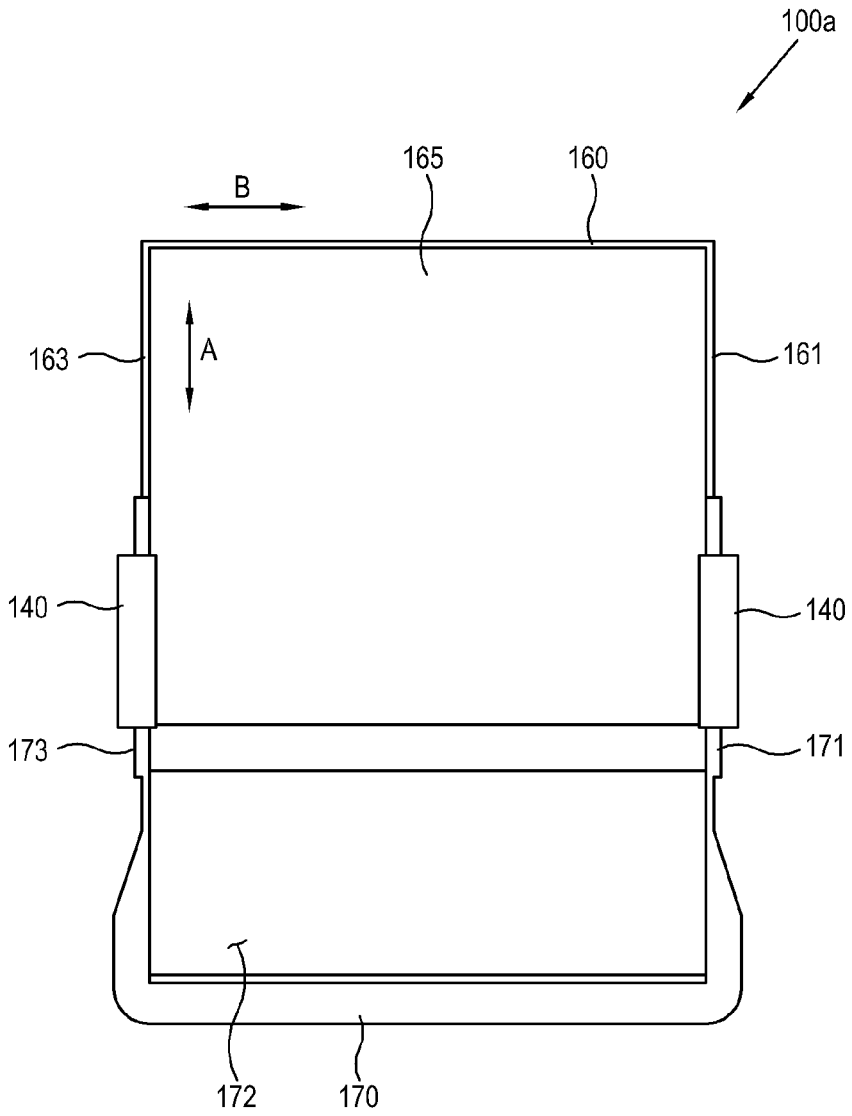
FIG. 18 is a plan view illustrating a printing medium feeding cassette according to an exemplary embodiment of the present general inventive concept.
Figure 19:
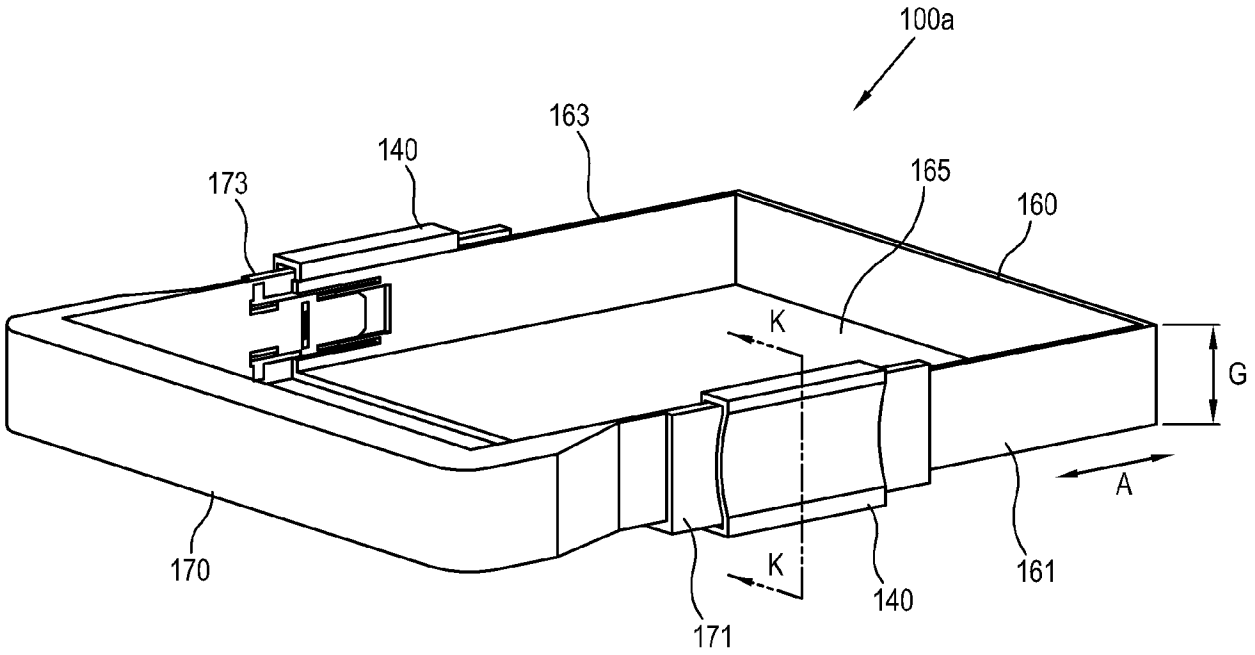
FIG. 19 is a schematic perspective view illustrating the printing medium feeding cassette illustrated in FIG. 18.
Figure 20:
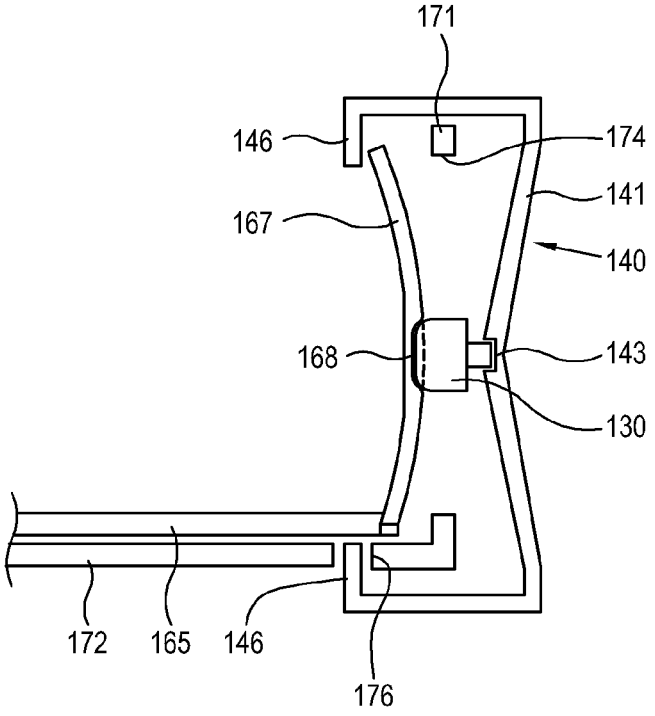
FIG. 20 is a schematic section view taken along line K-K in the printing medium feeding cassette illustrated in FIG. 19.

FIGS. 18 to 20 illustrate a printing medium feeding cassette 100*a* according to an exemplary embodiment. As illustrated in FIGS. 18 to 20, according to the present exemplary embodiment, a stopper 130 and a releasing member 140 are installed on side walls 161 and 163 of a first casing 160 and side walls 171 and 173 of a second casing 170, unlike the previous exemplary embodiments described with reference to FIGS. 2 to 17 in which the stopper 130 and the releasing member 140 are installed on the base supports 111 and 126 of the first casing 110 and the second casing 120, respectively.

In FIGS. 18 to 20, the stopper 130 and the releasing member 140 are installed on opposite coupling areas of the side walls 161 and 163 of the first casing 160 and the side walls 171 and 173 of the second casing 170. However, the present general inventive concept is not limited thereto. That is, in alternative exemplary embodiments, the stopper 130 and the releasing member 140 may be installed on any one of the coupling areas as necessary.

The first casing 160 includes a base support 165 on which a printing medium can be supported and the side walls 161 and 13 which are disposed on opposite sides of the base support 165. Each of the side walls 161 and 163 includes a guide member 167 which is arranged along a sliding direction A. As illustrated in FIG. 20, the guide member 167 may have a curved shape which is outwardly convex at a central portion thereof. The guide member 167 may include a plurality of coupling parts 168 which may be arranged along the sliding direction A.

The second casing 170 includes a base support 172 on which a printing medium can be supported and the side walls 171 and 173 which are installed on opposite sides of the base support 172.

In exemplary embodiments, the side walls 161 and 163 of the first casing 160 may slide inside of the side walls 171 and 173 of the second casing 170 in the sliding direction A. However, the present general inventive concept is not limited thereto. That is, in alternative exemplary embodiments, the side walls 161 and 163 of the first casing 160 may slide over the side walls 171 and 173 of the second casing 170, along the sliding direction A.

Each of the side walls 171 and 173 may be formed with a stopper inserting hole 174. The stopper inserting hole 174 may be provided as an elongated hole or slot which is formed in a direction G transverse to the sliding direction A, and may regulate the movement of the stopper 130 so that the stopper 130 moves in the transverse direction G.

As illustrated in FIG. 20, a lower bent part 146 among a plurality of bent parts 146 of the releasing member 140 may insert into a bent part guide groove 176 of the second casing 170. The bent part guide groove 176 is formed along the sliding direction A, and thus, the releasing member 140 may slide along the bent part guide groove 176 in the sliding direction A.

A process of adjusting the size of the printing medium feeding cassette 100*a* according to the present exemplary embodiment is substantially similar as in the printing medium feeding cassette 100 according to the previous exemplary embodiment, and thus, detailed description thereof is omitted.

Although a few exemplary embodiments of the present general inventive concept have been illustrated and described, it will be appreciated by those skilled in the art that changes may be made in these exemplary embodiments without departing from the principles and spirit of the present general inventive concept, the scope of which is defined in the appended claims and their equivalents.

What is claimed is:

1. A printing medium feeding cassette usable with an image forming apparatus, comprising:

a first casing which comprises a guide member which extends along a sliding direction, and a plurality of coupling parts arranged in a central area of the guide member to be spaced from each other along the sliding direction;

a second casing to form a printing medium containing space in cooperation with the first casing and to be configured to slide along the guide member;

a stopper to reciprocate in a direction transverse to the sliding direction between a coupling position in which the stopper is coupled with any one of the plurality of coupling parts and a releasing position in which the stopper is released from the coupling part; and a releasing member which is coupled with the second casing to move in the sliding direction in connection with the second casing and is moved by an external force applied thereto in the sliding direction to allow the stopper to move to the releasing position from the coupling position.

2. The printing medium feeding cassette according to claim 1, wherein the releasing position comprises:

a first releasing position and a second releasing position each corresponding to a first side and a second side of the guide member which are spaced from the central area of the guide member in the transverse direction.

3. The printing medium feeding cassette according to claim 1, wherein the releasing member comprises:

a manipulation part to which the external force is applied; and a stopper guide part which is provided to the manipulation part to guide the stopper from the coupling position to the releasing position.

4. The printing medium feeding cassette according to claim 2, wherein the stopper guide part comprises a guide groove which crosses the sliding direction at an acute angle.

5. The printing medium feeding cassette according to claim 4, wherein the manipulation part comprises:

a base plate;

a flange part which extends from the base plate towards the second casing; and a bent part which is bent from the flange part in the transverse direction, and wherein the second casing comprises:

a bent part inserting hole through which the bent part is inserted;

a sliding groove in which the flange part moves in the sliding direction; and a stopper inserting hole in which the stopper is accommodated.

6. The printing medium feeding cassette according to claim 5, wherein the stopper inserting hole comprises an elongated hole formed along the transverse direction to regulate a movement of the stopper.

7. The printing medium feeding cassette according to claim 6, wherein the manipulation part moves relative to the second casing in the sliding direction, with respect to the stopper inserting hole.

8. The printing medium feeding cassette according to claim 5, wherein the second casing further comprises a plurality of elastic member holders spaced apart from the stopper inserting hole in the transverse direction, and wherein the releasing member further comprises a plurality of elastic member supports spaced apart from opposite sides of each elastic member holder along the sliding direction.

9. The printing medium feeding cassette according to claim 8, further comprising:

a plurality of elastic members arranged between each elastic member holder and the plurality of elastic member supports to elastically bias the manipulation part so that the stopper is located in the coupling position.

10. The printing medium feeding cassette according to claim 2, wherein the manipulation part receives therein the guide member and is coupled with the second casing to move in the sliding direction.

11. The printing medium feeding cassette according to claim 10, further comprising:

an elastic member to elastically bias the manipulation part so that the stopper is located in the coupling position.

12. The printing medium feeding cassette according to claim 10, wherein a distance between the manipulation part and the guide member gradually increases toward the releasing position from the coupling position.

13. The printing medium feeding cassette according to claim 12, wherein the manipulation part comprises approximately an 'M' shaped section.

14. The printing medium feeding cassette according to claim 12, wherein the guide member comprises a curved shape which is convex at the central area.

15. The printing medium feeding cassette according to claim 1, wherein the guide member, the stopper, and the releasing member are installed on at least one of opposite side walls of the first and second casings.

16. An image forming apparatus comprising:

a printing medium feeding cassette, comprising:

a first casing which comprises a guide member which extends along a sliding direction, and a plurality of coupling parts arranged in a central area of the guide member to be spaced apart from each other along the sliding direction;

a second casing which forms a printing medium containing space in cooperation with the first casing and to be configured to slide along the guide member;

a stopper to reciprocate in a direction transverse to the sliding direction between a coupling position in which the stopper is coupled with any one of the plurality of coupling parts and a releasing position in which the stopper is released from the coupling part; and an image forming unit to form an image on a printing medium loaded on the printing medium feeding cassette.

17. A printing medium feeding cassette usable with an image forming apparatus, comprising:

a first casing having a plurality of coupling parts coupled to a second casing to define a print medium containing space, the first casing movable along a first direction;

a stopper configured to move between a plurality of positions along a second direction; and a releasing member configured to move with the second casing in the first direction to thereby move the stopper to a first position where the stopper is coupled to at least one of the plurality of coupling parts and to a second position where the stopper is spaced apart from the plurality of coupling parts.

18. The printing medium feeding cassette of claim 17, wherein the first casing moves with respect to the second casing such that a length of the printing medium containing space changes.

19. The printing medium feeding cassette of claim 17, wherein the first casing further comprises a guide member which extends in the first direction and includes the plurality of coupling parts disposed on a central portion thereof.

20. The printing medium feeding cassette of claim 17, wherein the plurality of coupling parts are spaced apart from each other along the first direction to correspond with a size of a printing medium.

21. The printing medium feeding cassette of claim 17, wherein the second position of the stopper is spaced apart from the first position of the stopper along the second direction.

22. The printing medium feeding cassette of claim 21, wherein a distance between the releasing member and the first casing increases from the first position of the stopper toward the second position of the stopper.

23. A printing medium feeding cassette usable with an image forming apparatus, comprising:

a first casing having a plurality of coupling parts;

a second casing connectable to the first casing to move along a first direction with respect to the first casing;

a releasing member having a groove disposed along a second direction transverse with the first direction; and a stopper member movable along the second direction to be coupled to one of the plurality of coupling parts corresponding to a size of printing medium disposed within a space defined by the first and the second casing.

24. The printing medium feeding cassette of claim 23, wherein the stopper member moves away from a first position corresponding to the plurality of coupling parts along the groove when a force is applied to the releasing member along the first direction.

25. The printing medium feeding cassette of claim 24, wherein the second casing further comprises a stopper inserting hole to transfer the force applied to the releasing member to the stopper member such that the stopper moves along the groove.

26. The printing medium feeding cassette of claim 24, wherein the plurality of coupling parts are disposed along a central portion of the first casing along the first direction.

27. The printing medium feeding cassette of claim 26, wherein the groove guides the stopper member to a second position away from the central portion of the first casing where the stopper is released from the plurality of coupling parts so that the second casing moves with respect to the first casing to accommodate a different size printing medium.

* * * * *